US005587727A

United States Patent [19]

Sugahara et al.

[11] Patent Number: 5,587,727

[45] Date of Patent: Dec. 24, 1996

[54] INK JET APPARATUS USING PRESSURE WAVE INTERSECTION TO EJECT INK DROPLETS

[75] Inventors: Hiroto Sugahara, Ama-gun; Yoshikazu Takahashi, Kasugai, both of Japan

[73] Assignee: Brother Kogyo Kabushiki Kaisha, Nagoya, Japan

[21] Appl. No.: 222,594

[22] Filed: Apr. 4, 1994

[30] Foreign Application Priority Data

Apr. 23, 1993 [JP] Japan ..... 5-097468
Jun. 1, 1993 [JP] Japan ..... 5-130282

[51] Int. Cl.[6] ..... B41J 29/38

[52] U.S. Cl. ..... 347/12; 347/40; 347/48

[58] Field of Search ..... 347/40, 48, 68, 347/70, 71, 94, 9, 10, 54, 73–75, 12, 13

[56] References Cited

U.S. PATENT DOCUMENTS

| | | | |
|---|---|---|---|
| 4,291,316 | 9/1981 | Kakeno et al. | 347/68 |
| 4,303,927 | 12/1981 | Tsao | 347/40 |
| 4,716,418 | 12/1987 | Heinzl et al. | 347/68 |
| 4,879,568 | 11/1989 | Bartky et al. | 347/69 |
| 4,887,100 | 12/1989 | Michaelis et al. | 347/69 |
| 4,992,808 | 2/1991 | Bartky et al. | 347/69 |
| 5,003,679 | 4/1991 | Bartky et al. | 347/69 X |
| 5,016,028 | 5/1991 | Temple | 347/69 |
| 5,028,936 | 7/1991 | Bartky et al. | 347/69 |
| 5,229,793 | 7/1993 | Hadimioglu et al. | 347/46 |
| 5,461,403 | 10/1995 | Wallace et al. | 347/68 X |

FOREIGN PATENT DOCUMENTS

| | | | |
|---|---|---|---|
| 0094032 | 11/1983 | European Pat. Off. . | |
| 0275211 | 7/1988 | European Pat. Off. . | |
| 0354706 | 2/1990 | European Pat. Off. . | |
| 0550148 | 7/1993 | European Pat. Off. . | |
| 60-104337 | 6/1985 | Japan | 347/68 |

*Primary Examiner*—John E. Barlow, Jr.
*Attorney, Agent, or Firm*—Oliff & Berridge

[57] ABSTRACT

A pressure wave pulse having a maximum pressure P1 and a width T generated from a piezoelectric element moves in a longitudinal direction. A pressure wave pulse having a maximum pressure Q and a width T generated from another piezoelectric element moves in any opposite direction. When the two pressure wave pulses overlap each other, a synthetic wave having a magnitude P and a width T is generated to thereby jet ink from a nozzle. At this time, a pressure having a magnitude greater than the magnitude P is temporarily applied several times to nozzles adjacent to the nozzle. However, a duration of the pressure applied is not enough to jet the ink from the adjacent nozzles.

17 Claims, 13 Drawing Sheets

INK JET APPARATUS USING PRESSURE WAVE INTERSECTION TO EJECT INK DROPLETS

BACKGROUND OF THE INVENTION

1. Field of the Invention

The invention relates to an ink jet apparatus.

2. Description of Related Art

As a printer head, there has conventionally been proposed a drop-on-demand type of ink jet printer head using piezoelectric ceramics. In this type of ink jet printer head, the volume of an ink chamber is changed by deforming the piezoelectric ceramics. When the volume is decreased, ink contained in the ink chamber is expelled in the form of droplets from a nozzle, whereas when the volume is increased, additional ink is introduced from an ink supply passage into the ink chamber. A plurality of such nozzles are arranged in neighboring relationship to each other, and the ink droplets are expelled from desired ones of the nozzles according to desired print data to thereby form desired characters or images on a sheet of paper or the like opposed to the nozzles.

This kind of ink jet apparatus is disclosed in U.S. Pat. Nos. 4,879,568; 4,887,100; 4,992,808; and 5,003,679; U.S. Pat. No. 5,028,936 (corresponding to Japanese Patent Laid-open Nos. Sho 63-247051 and 63-252750); and U.S. Pat. No. 5,016,028 (corresponding to Japanese Patent Laid-open No. Hei 2-150355), for example. FIGS. 15 to 19 schematically show such a conventional ink jet apparatus.

The structure of such a conventional ink jet apparatus will now be described with reference to FIG. 15 which shows a cross section thereof. Reference numeral 1 denotes a piezoelectric ceramics plate having a plurality of grooves 15 and side walls 11 partitioning these grooves 15 and polarized in a direction depicted by an arrow 4. Reference numeral 2 denotes a cover plate formed of a one of several materials, such as ceramics and resins. The piezoelectric ceramics plate 1 and the cover plate 2 are bonded together by an adhesive layer 3 formed of an epoxy adhesive, for example, whereby the plural grooves 15 are formed as a plurality of ink chambers 12 spaced from each other in a transverse direction of the piezoelectric ceramics plate 1. Each ink chamber 12 is rectangular in cross section and is elongated over the length of the piezoelectric ceramics plate 1. Each side wall 11 extends over the length of the ink chamber 12 it defines. The adhesive layer 3 is formed on the upper surface of each side wall 11. A pair of metal electrodes 13, for applying a driving electric field, are formed on the opposed side surfaces of each ink chamber 12 at an upper half portion thereof. All of the ink chambers 12 are filled with ink.

The operation of the ink jet apparatus shown in FIG. 15 will now be described with reference to FIG. 16 showing a cross section thereof. When the ink chamber **12*b*, as an exemplary one of the ink chambers 12, is selected according to desired print data, a positive driving voltage is rapidly applied to the metal electrodes 13*e* and 13*f*, formed on the inside of the ink chamber 12*b*, and the metal electrodes 13*d* and 13*g* formed on the outside of the ink chamber 12*b* are grounded. As a result, a driving electric field having a direction 14*b* is generated in the side wall 11*b*, and a driving electric field having a direction 14*c* is generated in the side wall 11*c*. As the directions 14*b* and 14*c* of the driving electric fields are perpendicular to the direction 4 of polarization of the piezoelectric ceramics plate 1, the side walls 11*b* and 11*c* are rapidly deformed inwardly of the ink chamber 12*b* by a piezoelectric thickness shear effect. This deformation of the side walls 11*b* and 11*c* reduces the volume of the ink chamber 12*b* to rapidly increase the pressure of the ink contained in the groove 12*b* and thereby generate a pressure wave. As a result, the ink droplets are expelled from a nozzle 32 (see FIG. 17) communicating with the ink chamber 12*b*. Further, when the application of the driving voltage is gradually stopped, the side walls 11*b* and 11*c* gradually restore their original positions before deformation (see FIG. 15), and the pressure of the ink contained in the ink chamber 12*b* is therefore gradually decreased. As a result, additional ink is supplied from an ink inlet hole 21 through a manifold 22 (see FIG. 17) into the ink chamber 12*b***.

The above operation is merely a basic operation of the ink jet apparatus in the prior art. In an actual product, however, a driving voltage may be first applied in a such a direction as to increase the volume of the ink chamber **12*b* to supply the ink into the ink chamber 12*b* before expelling the ink, and thereafter the application of the driving voltage may be rapidly stopped to return the side walls 11*b* and 11*c*** to the original positions and thereby expel the ink.

The structure and a manufacturing method for the ink jet apparatus shown in FIG. 15 will now be described with reference to FIG. 17 showing a perspective view thereof. The parallel grooves 15 forming the ink chambers 12 are formed in the piezoelectric ceramics plate 1 by cutting with use of a thin, disk-shaped diamond blade. All the grooves 15 are parallel and have the same depth over almost the entire length of the piezoelectric ceramics plate 1. The depth of each groove 15 is gradually reduced as it approaches a rear end surface 17 of the piezoelectric ceramics plate 1 to form a shallow groove 18 near the rear end surface 17. Thereafter, the metal electrodes 13 are formed on the inner surfaces of the grooves 15 and the shallow grooves 18 by a known technique such as sputtering. More specifically, the metal electrodes 13 are formed on the upper half portions of the inner side surfaces of the grooves 15 and also on the inner side and bottom surfaces of the shallow grooves 18. On the other hand, the ink inlet hole 21 and the manifold 22 are formed in the cover plate 2 by a method such as grinding or cutting.

Then, the lower surface of the cover plate 2, in which the manifold 22 is formed, is bonded to the upper surface of the piezoelectric ceramics plate 1, in which the grooves 15 are formed, by means of an epoxy adhesive or the like, thereby defining the ink chambers 12 from the grooves 15. Then, a nozzle plate 31, having the nozzles 32 arranged at the positions corresponding to the front end positions of the ink chambers 12, is bonded to the front end surface of the assembly of the piezoelectric ceramics plate 1 and the cover plate 2. A substrate 41, having a plurality of conductor film patterns 42 arranged at the positions corresponding to the rear end positions of the ink chambers 12, is bonded to the lower surface of the piezoelectric ceramics plate 1, on the opposite side from the cover plate 2, by means of an epoxy adhesive or the like. Then, each conductor film pattern 42 is connected by wire bonding through a conductor wire 43 to the metal electrode 13 which is also formed on the bottom surface of the shallow groove 18 contiguous to the corresponding groove 15.

The structure of a control section for controlling the ink jet apparatus shown in FIG. 17 will be described with reference to FIG. 18 which shows a block diagram of the control section. The conductor film patterns 42 formed on the substrate 41 are individually connected to an LSI chip 51. Also connected to the LSI chip 51 are a clock line 52, a data line 53, a voltage line 54, and a ground line 55. The LSI chip 51 determines which nozzle 32 the ink droplets are to be expelled from according to data appearing on the data line 53 on the basis of continuous clock pulses supplied from the clock line 52. Then, according to the result of the determination, the LSI chip 51 applies a voltage V from the voltage line 54 to the conductor film pattern 42 connected to the metal electrode 13 in the ink chamber 12 to be driven. Further, the LSI chip 51 applies the zero voltage of the ground line 55 to the other conductor film patterns 42 connected to the metal electrodes 13 in the ink chambers 12 that are not to be driven.

Next, a printer employing the ink jet apparatus of the prior art will be described with reference to FIG. 19, showing a perspective view of the printer. The printer shown in FIG. 19 includes an ink jet apparatus 61 and a nozzle plate 31 similar in constitution and operation to those shown in FIGS. 15 to 17.

The ink jet apparatus 61 is fixed to a carriage 62. An ink supply tube 63 is connected to the ink inlet hole 21 (see FIG. 17). The LSI chip 51 (see FIG. 18) is installed in the carriage 62. A flexible cable 64 corresponds to the clock line 52, the data line 53, the voltage line 54, and the ground line 55 shown in FIG. 18. The carriage 62 is reciprocated along a slider 66 in opposite directions depicted by a double-headed arrow 65, over the width of a recording paper 71. During movement of the carriage 62, the ink jet apparatus 61 operates to jet ink droplets from nozzles 32 (see FIG. 17) of the nozzle plate 31 onto the recording paper 71 supported on a platen roller 72, thereby depositing the ink droplets on the recording paper 71. When the ink jet apparatus 61 jets the ink droplets, the recording paper 71 is kept at rest. Every time the carriage 62 changes the direction of reciprocation, the recording paper 71 is fed by paper feed rollers 73,74 by a given amount in a direction depicted by arrow 75 in FIG. 19. Accordingly, the ink jet apparatus 61 can form desired characters or images on the whole surface of the recording paper 71.

In the conventional ink jet apparatus 61 described above, however, the pressure wave generated in the ink contained in the ink chamber 12 scans toward the corresponding nozzle 32 to jet the ink droplets from the nozzle 32. Accordingly, the number of energy generating means including the side walls 11, the metal electrodes 13, and the number of the ink chambers 12 must be equal to the number of the nozzles 32. As a result, the structure of the apparatus 61 becomes complicated and a driving circuit for driving the energy generating means becomes complicated and enlarged in size. Accordingly, the ink jet apparatus 61 increases in cost and size as a whole.

Further, in forming a so-called line head such that the nozzles 32 of the ink jet apparatus 61 are arranged with the same integration degree as that desired to deposit the ink droplets on the recording paper 71 and arranged over the width of the recording paper 71, the numbers of the energy generating means and the ink chambers 12 are greatly increased to cause a great increase in cost and size of the ink jet apparatus 61 as a whole.

SUMMARY OF THE INVENTION

It is accordingly an object of the invention to provide an ink jet apparatus which can be manufactured at a low cost with a reduced size by simplifying the structure of the apparatus and simplifying the driving circuit for driving the energy generating means to reduce the size of the driving circuit.

According to a first aspect of the invention, there is provided an ink jet apparatus comprising an ink chamber filled with ink, a jet nozzle communicating with the ink chamber, and energy generating means for generating a pressure wave in the ink contained in the ink chamber to jet the ink from the jet nozzle, the energy generating means being reduced in number less than the jet nozzle; wherein a scanning direction of the pressure wave generated in the ink contained in the ink chamber by the energy generating means is substantially perpendicular to the jet nozzle.

According to a second aspect of the invention, there is provided an ink jet apparatus comprising one ink chamber filled with ink, a plurality of jet nozzles communicating with the ink chamber, and energy generating means for generating pressure waves in the ink contained in the ink chamber to jet the ink from the jet nozzles; wherein one of the pressure waves generated by the energy generating means is synthesized with another one of the pressure waves generated by the energy generating means to thereby jet the ink from the jet nozzles.

In the ink jet apparatus according to the first aspect of the invention, the number of energy generating means is smaller than the number of jet nozzles, and the scanning direction of the pressure wave generated in the ink contained in the ink chamber is substantially perpendicular to the jet nozzle. Accordingly, the structure of the apparatus can be simplified, and the driving circuit for driving the energy generating means can be simplified and reduced in size.

In the ink jet apparatus according to the second aspect of the invention, the pressure waves generated by the energy generating means in the ink contained in the ink chamber are synthesized to thereby jet the ink from the jet nozzles. Accordingly, the structure of the apparatus can be simplified and the driving circuit for driving the energy generating means can be simplified and reduced in size.

Other objects and features of the invention will be more fully understood from the following detailed description and appended claims when taken with the accompanying drawings.

DESCRIPTION OF THE PREFERRED EMBODIMENTS

Figure 1:
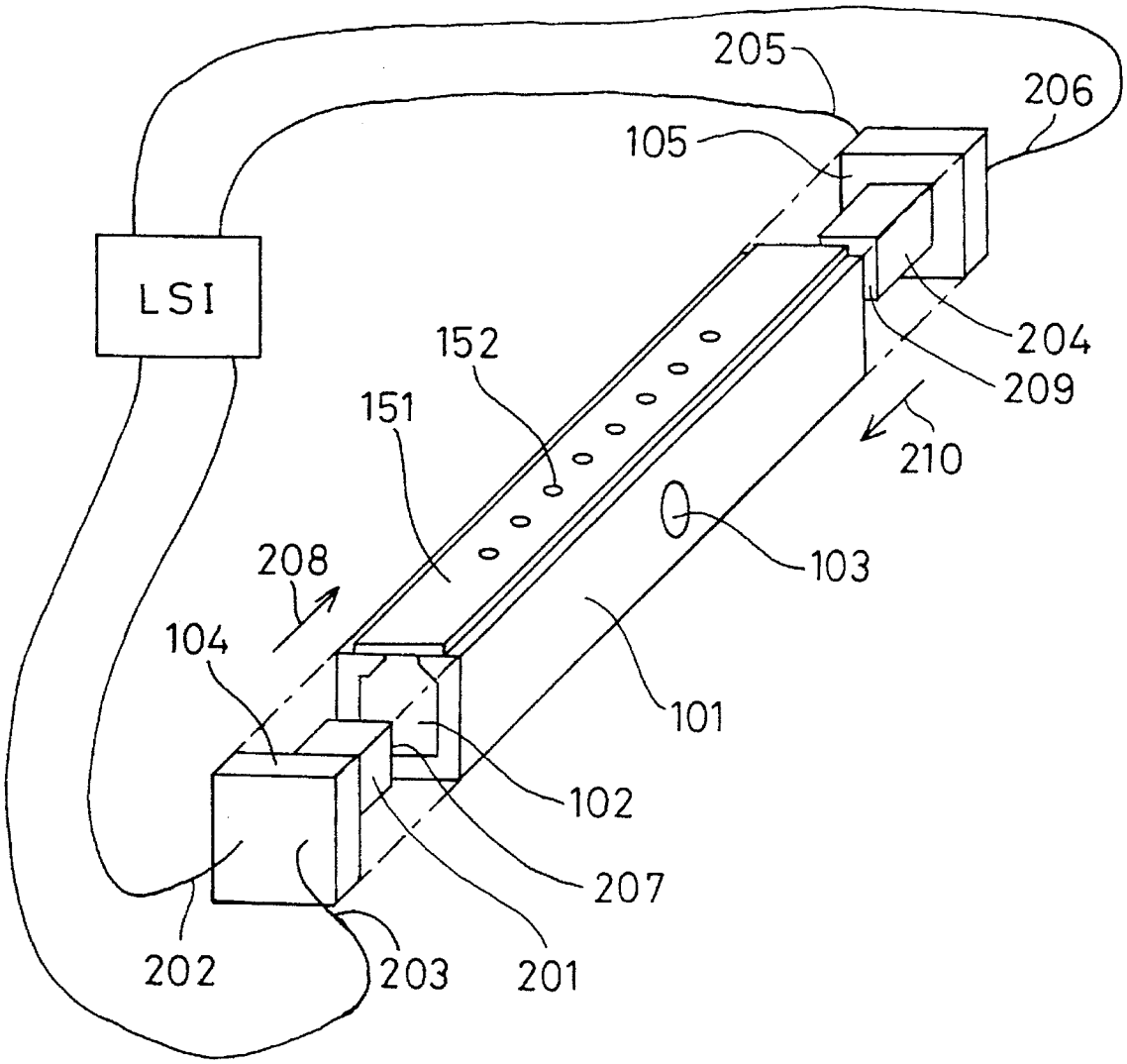
FIG. 1 is a perspective view of an ink jet apparatus in a first preferred embodiment according to the invention.

The structure of a first preferred embodiment according to the invention will be described with reference to FIG. 1, which is a perspective view of an ink jet apparatus of the first preferred embodiment.

Reference numeral 101 denotes a chamber forming member elongated in shape to define therein an ink chamber 102. The ink chamber 102 extends in a longitudinal direction of the chamber forming member 101 over the length thereof. The chamber forming member 101 is provided with an ink inlet hole 103 communicating with the ink chamber 102. The ink inlet hole 103 is connected through an ink supply pipe (not shown) to an ink tank (not shown). The ink chamber 102 is open at its upper portion to the upper surface of the chamber forming member 101, and a nozzle plate 151 having a plurality of nozzles 152 is bonded to the upper surface of the chamber forming member 101. The ink chamber 102 is open also at its opposite ends of the chamber forming member 101. A pair of cover members 104,105 are bonded to the opposite end surfaces of the chamber forming member 101 to close the open ends of the ink chamber 102. Thus, the ink chamber 102 is fully closed except the ink inlet hole 103 and the nozzles 152.

An end surface of a piezoelectric element 201 is bonded to the surface of the cover member 104 which surface is to be bonded to one of the end surfaces of the chamber forming member 101, and the piezoelectric element 201 is disposed in the ink chamber 102. A pair of conductor wires 202,203 are electrically connected to electrodes provided on the piezoelectric element 201, so that when a driving voltage is applied between the conductor wires 202,203, the piezoelectric element 201 produces an expansive deformation of about several nanometers to hundreds of micrometers in a direction inward of the chamber forming member 101, i.e., in a direction depicted by an arrow 208 in FIG. 1. Similarly, an end surface of another piezoelectric element 204 is bonded to the surface of the cover member 105 which surface is to be bonded to the other end surface of the chamber forming member 101, and the piezoelectric element 204 is disposed in the ink chamber 102. A pair of conductor wires 205,206 are electrically connected to electrodes provided on the piezoelectric element 204, so that when a driving voltage is applied between the conductor wires 205,206, the piezoelectric element 204 produces an expansive deformation in a direction inward of the chamber forming member 101, i.e., in a direction depicted by an arrow 210 in FIG. 1. Each of the piezoelectric elements 201,204 may be constructed of a piezoelectric ceramic having a shape of rectangular parallelepiped in which electrodes are formed on the whole or a part of at least two opposite surfaces, or may be constructed of a stacked type of piezoelectric actuator.

The conductor wires 202,203,205,206 are electrically connected to an LSI chip constituting a voltage applying circuit, so that the application of the driving voltages to the piezoelectric elements 201,204 is controlled by the LSI chip.

Figure 2A:
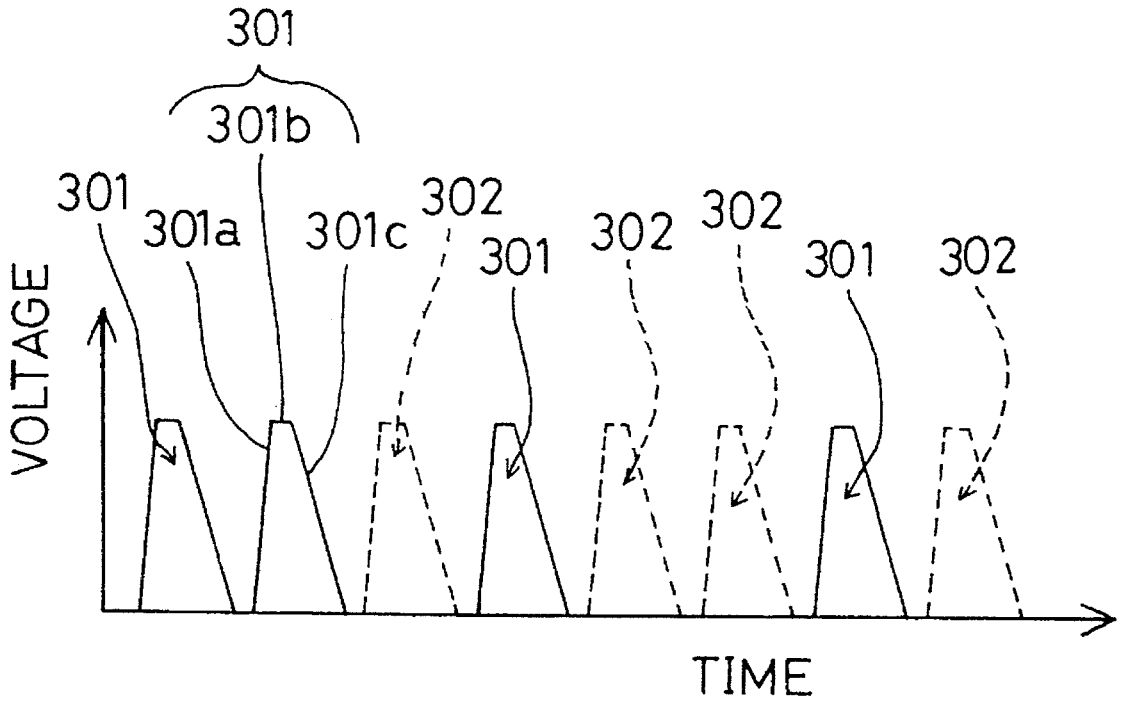
FIGS. 2A and 2B are waveform charts of driving voltage pulses to be applied to piezoelectric elements shown in FIG. 1.
Figure 2B:
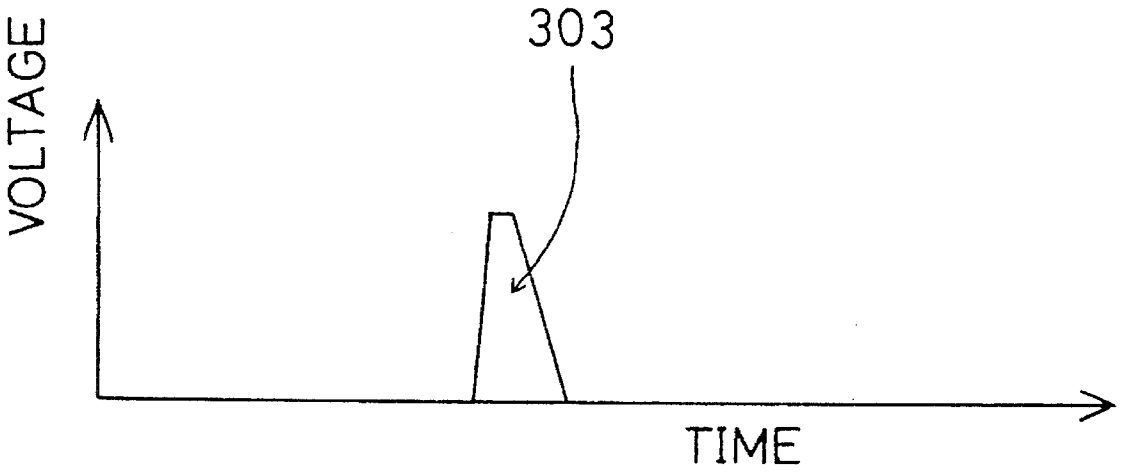
Figure 3A:
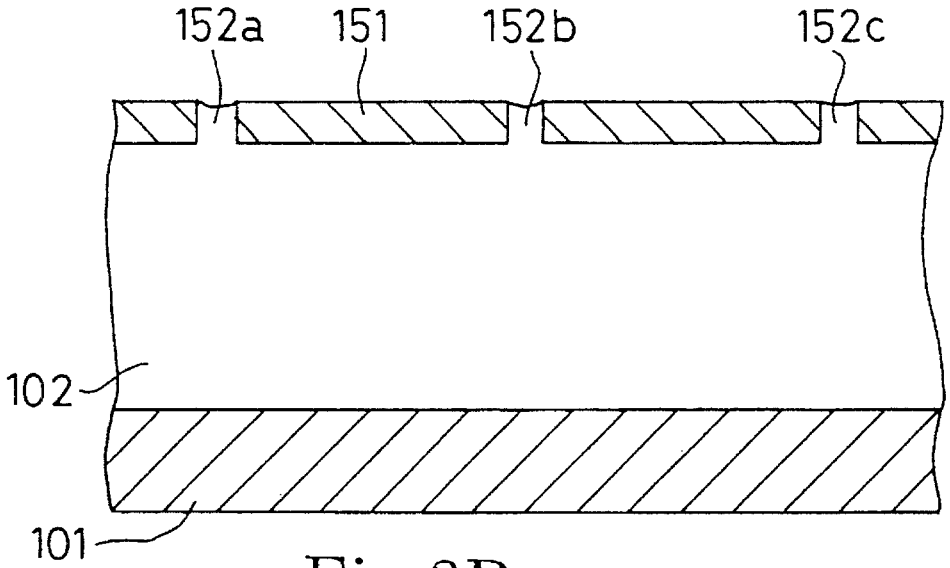
FIG. 3A is an enlarged sectional view of a part of an ink chamber shown in FIG. 1.
Figure 3B:
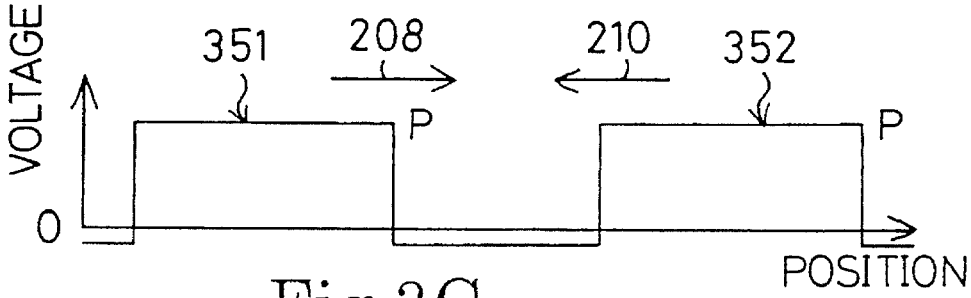
FIGS. 3B to 3D are waveform charts of pressure wave pulses generated by the piezoelectric elements shown in FIG. 1.
Figure 3C:
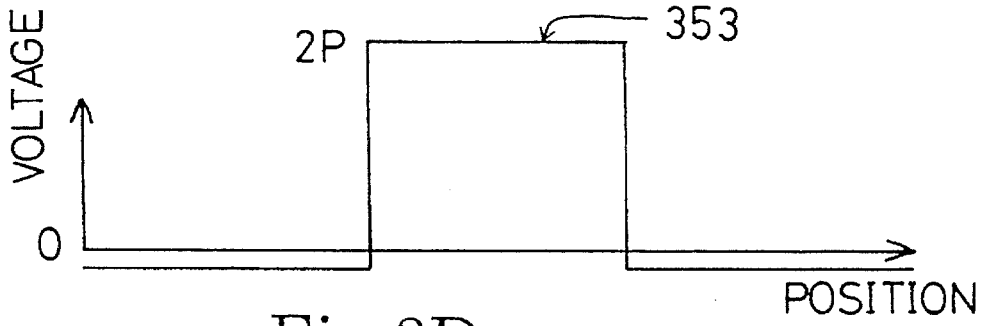
Figure 3D:
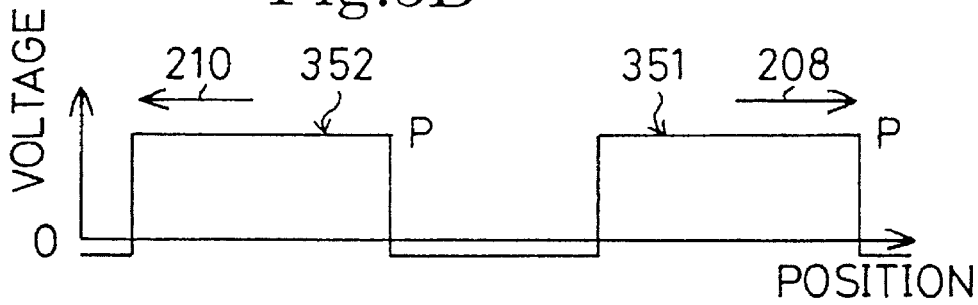
Figure 4:
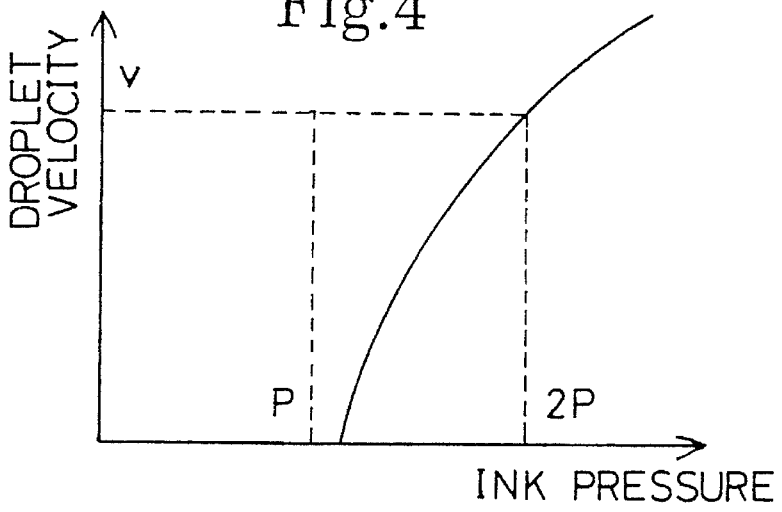
FIG. 4 is a graph showing a relation between ink pressure and droplet velocity.

The operation of the first preferred embodiment will now be described with reference to FIGS. 2A and 2B showing waveforms of driving voltage pulses to be applied to the piezoelectric elements 201,204, FIGS. 3A to 3D showing a condition of synthesis of pressure wave pulses, and FIG. 4 showing a relationship between ink pressure and droplet velocity.

First, a condition of generation of pressure wave pulses by the piezoelectric elements 201,204 will be described. As shown in FIG. 2A, a plurality of driving voltage pulses 301 each composed of a rise portion 301*a*, a hold portion 301*b*, and a fall portion 301*c* are applied between the conductor wires 202,203 (see FIG. 1). At the time of application of the rise portion 301*a*, the piezoelectric element 201 produces the expansive deformation in the direction of the arrow 208 (see FIG. 1) at a velocity corresponding to a rise speed of the driving voltage, so that an end surface 207 (see FIG. 1) of the piezoelectric element 201 compresses the ink contained in the ink chamber 102 in contact with the end surface 207. Thereafter at the start of the application of the hold portion 301*b*, the expansive deformation of the piezoelectric element 201 is stopped, and simultaneously the compression of the ink is ended. As a result, pulses of pressure waves (compression waves) are generated from the ink near the end surface 207 to travel through the ink chamber 102 (see FIG. 1) in the direction of the arrow 208 (see FIG. 1) at a velocity of hundreds to thousands of meters per second. Thereafter, at the time of application of the fall portion 301*c*, the piezoelectric element 201 produces a contractive deformation in a direction reverse to that of the expansive deformation at a velocity corresponding to a fall speed of the driving voltage, resulting in generation of a negative pressure near the end surface 207. However, as the speed of the fall portion 301*c* is set lower than that of the rise portion 301*a*, the negative pressure generated near the end surface 207 is small.

Similarly, as shown in FIG. 2B, a driving voltage pulse 303 is applied between the conductor wires 205,206 (see FIG. 1), so that a pressure wave pulse is generated from the ink near an end surface 209 (see FIG. 1) of the piezoelectric element 204 to travel in the ink chamber 102 in the direction of the arrow 210 (see FIG. 1). The driving voltage pulse 303 to be applied to the piezoelectric element 204 has the same waveform as that of the driving voltage pulses 301 composed of the rise portion 301*a*, the hold portion 301*b*, and the fall portion 301*c* as shown in FIG. 2A. However, a hold portion of the driving voltage pulse 303, corresponding to the hold portion 301*b*, may be omitted. Further, although the waveform of each of the driving voltage pulses 301 and 303 is wholly formed by straight lines as shown in FIGS. 2A and 2B, a part or the whole of the waveform may be formed by a curved line.

Next, a condition of synthesis of the pressure wave pulses and a condition of jetting of ink droplets will be described. It is assumed that the ink droplets are jetted from the nozzle 152*b* shown in FIG. 3A. As shown in FIG. 3B, a pressure wave pulse 351 having a maximum pressure P generated from the piezoelectric element 201 moves in the direction of the arrow 208, whereas a pressure wave pulse 352 having a maximum pressure P generated from the piezoelectric element 204 moves in the direction of the arrow 210. Thus, the pressure wave pulses 351,352 approach each other. Just thereafter, as shown in FIG. 3C, the pressure wave pulses 351,352 overlap to generate a synthetic region 353 having a maximum pressure 2 P obtained as the double of the maximum pressure P of each of the pressure wave pulses 351 and 352. Thereafter, when the pressure wave pulses 351 and 352 pass each other as shown in FIG. 3D, the synthetic region 353 having the maximum pressure 2 P disappears.

Thus, the scan of the pressure wave pulses 351,352 in the ink chamber 102 causes the pressure P to be temporarily applied to the nozzles 152 as the pressure waves pass. In particular, the pressure 2 P is temporarily applied to the nozzle 152*b* only because the synthetic region 353 having the maximum pressure 2 P is generated just under the nozzle 152*b*. Further, the scan of the pressure wave pulses 351,352 in the ink chamber 102 also causes the pressure P to be temporarily applied to the ink inlet hole 103. However, since the ink inlet hole 103 is filled with the ink, the pressures of the pressure wave pulses 351,352 have almost no influence upon the ink tank, and a pressure loss of the pressure wave pulses 351,352 at the ink inlet hole 103 is small. In general, an ink pressure is related to a droplet velocity as shown in FIG. 4. Accordingly, when the pressure P is set so that the ink droplets are not jetted under the pressure P, but they are jetted under the pressure 2 P, the ink droplets are jetted from the nozzle 152*b* only by generating the pressure wave pulses 351,352. Further, by changing a timing of generation of the pressure wave pulses 351,352 from the piezoelectric elements 201,204, the ink droplets can be jetted from any one of the nozzles 152.

In jetting the ink droplets from selected ones of the nozzles 152 so as to form desired characters or images, a train of the plural driving voltage pulses 301, as shown in FIG. 2A, is applied to the piezoelectric element 201, and the single driving voltage pulse 303 as shown in FIG. 2B is applied to the piezoelectric element 204. In FIG. 2A, dashed lines denote areas 302 where no driving voltage pulses are applied so as not to jet the ink droplets from unselected ones of the nozzles 152. The singularity of the driving voltage pulse 303 to be applied to the piezoelectric element 204 is not limited, but a train of two or more driving voltage pulses 303 set so as to form desired characters or images may be applied to the piezoelectric element 204.

In the ink jet apparatus in the first preferred embodiment, the piezoelectric elements 201,204 as energy generating means, are provided at the ends of the single ink chamber 102 communicating with the plural nozzles 152. Accordingly, the pressure waves generated in the ink contained in the ink chamber 102 from the piezoelectric elements 201, 204 move in a direction substantially perpendicular to the nozzles 152, and the ink droplets are jetted from the nozzles 152 by the synthesis of the pressure waves. In comparison with the conventional ink jet apparatus wherein the number of the ink chambers and the energy generating means is the same as the number of the nozzles, the ink jet apparatus in this preferred embodiment is reduced in the number of parts such that the ink chamber 102 is a single chamber and the number of the piezoelectric elements 201,204 as the energy generating means, is smaller than that of the nozzles 152. Especially, in forming a so-called line head such that an ink jet apparatus is arranged with the same integration degree as that desired to deposit ink droplets on a recording paper and extends over the width of the recording paper, the conventional ink jet apparatus is required to greatly increase the numbers of the energy generating means and the ink chambers. In comparison with this, the numbers of the energy generating means and the ink chambers can be greatly reduced in the preferred embodiment. Accordingly, the structure of the ink jet apparatus can be greatly simplified, and a driving circuit for driving the energy generating means can be simplified and reduced in size. Thus, the ink jet apparatus can be manufactured at a low cost with a reduced overall size.

Figure 5:
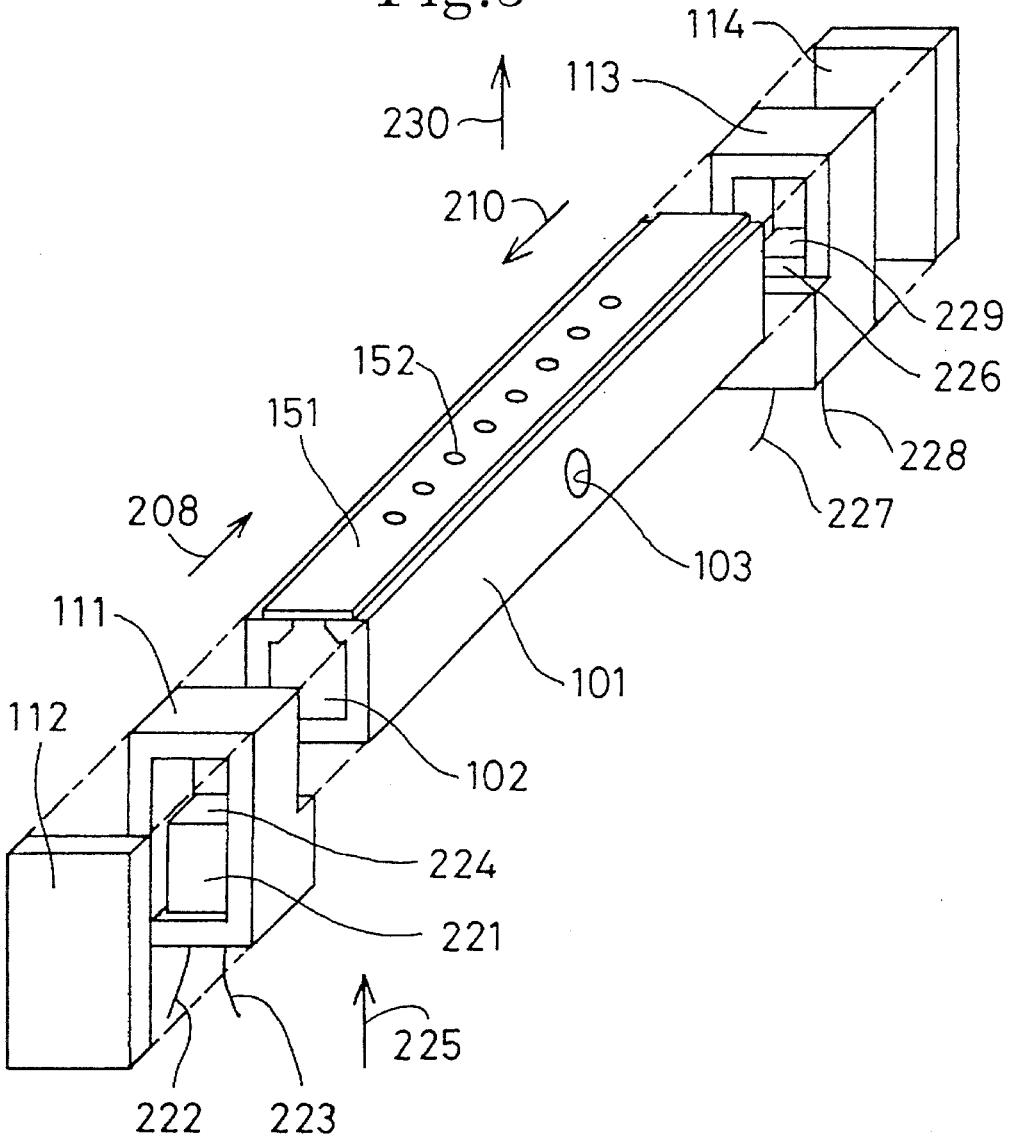
FIG. 5 is a perspective view of an ink jet apparatus in a second preferred embodiment according to the invention.

While the piezoelectric elements 201,204 produce the deformation in the longitudinal direction of the ink chamber 102, the deformation may be produced in any direction other than the longitudinal direction of the ink chamber 102. A second preferred embodiment embodying such a case will be described with reference to FIG. 5, in which the same parts as those of the first preferred embodiment are denoted by the same reference numerals and the explanation thereof will be omitted.

A pair of cover members 111,113 are bonded to opposite end surfaces of a chamber forming member 101, and a pair of cover members 112,114 are bonded to the cover members 111,113, respectively. An ink chamber 102 is fully closed by the cover members 111 to 114 and a nozzle plate 151 except an ink inlet hole 103 and a plurality of nozzles 152. A lower end surface of a piezoelectric element 221 is bonded to the bottom of an inner surface of the cover member 111, and a space is defined between the top of the inner surface of the cover member 111 and an upper end surface 224 of the piezoelectric element 221. This space defined in the cover member 111 constitutes a part of the ink chamber 102 and the piezoelectric element 221 is disposed in the ink chamber 102. A pair of conductor wires 222,223 are electrically connected to electrodes provided on the piezoelectric element 221, so that when a driving voltage is applied between the conductor wires 222,223, the piezoelectric element 221 produces an expansive deformation of about several nanometers to hundreds of micrometers in a direction depicted by an arrow 225 in FIG. 5. Similarly, a lower end surface of another piezoelectric element 226 is bonded to the bottom of an inner surface of the cover member 113, and a space is defined between the top of the inner surface of the cover member 113 and an upper end surface 229 of the piezoelectric element 226. This space defined in the cover member 113 constitutes a part of the ink chamber 102 and the piezoelectric element 226 is disposed in the ink chamber 102. A pair of conductor wires 227,228 are electrically connected to electrodes provided on the piezoelectric element 226, so that when a driving voltage is applied between the conductor wires 227,228, the piezoelectric element 226 produces an expansive deformation in a direction depicted by an arrow 230 in FIG. 5.

The operation of the second preferred embodiment will now be described. A plurality of driving voltage pulses 301 each composed of a rise portion 301*a*, a hold portion 301*b*, and a fall portion 301*c* as shown in FIG. 2A are applied between the conductor wires 222,223. At the time of application of the rise portion 301*a*, the piezoelectric element 221 produces the expansive deformation in the direction of the arrow 225 at a velocity corresponding to a rise speed of driving voltage, so that the upper end surface 224 of the piezoelectric element 221 compresses the ink contained in the space between the upper end surface 224 and the cover member 111. Thereafter at the same time of application of the hold portion 301*b*, the compression of the ink is ended. As a result, pulses of pressure waves (compression waves) are generated from the ink over the upper end surface 224 to travel in the ink chamber 102 in a direction depicted by an arrow 208 in FIG. 5 at a velocity of hundreds to thousands of meters per second. Similarly, a driving voltage pulse 303, as shown in FIG. 2B, is applied between the conductor wires 227,228, so that a pressure wave pulse is generated from the ink over the upper end surface 229 of the piezoelectric element 226 to travel in the ink chamber 102 in a direction depicted by an arrow 210 in FIG. 5.

The pressure wave pulses generated by the piezoelectric elements 221 and the pressure wave pulse generated by the piezoelectric element 226 are synthesized to thereby jet the ink droplets from the nozzles 152. Thus, substantially the same effect as that of the first preferred embodiment can be obtained.

While the two piezoelectric elements 201,204 or the two piezoelectric elements 221,226 are used in each of the first and second preferred embodiments, the piezoelectric element 204 or 226 may be replaced by a reflecting plate for reflecting a pressure wave pulse. In this modification, a pressure wave pulse preliminarily generated by the piezoelectric element 201 or 221 and reflected by the reflecting plate is synthesized with pressure wave pulses subsequently generated by the piezoelectric element 201 or 221 to thereby jet the ink droplets from the nozzles 152. Thus, the ink droplets can be jetted by the use of a single piezoelectric element. Further, three or more piezoelectric elements may be used to jet the ink droplets.

While the piezoelectric elements are used as the energy generating means in the first and second preferred embodiments, any other type of energy generating means may be used. For example, an energy generating means that can be used in the invention includes a heating element capable of effecting rapid growth and disappearance of air bubbles to thereby generate pressure wave pulses in the ink contained in the ink chamber 102, or a displacing mechanism using a solenoid, motor, oil pressure, or air pressure capable of effecting rapid displacement to thereby instantaneously compress the ink and generate pressure wave pulses. In this case, the number of the energy generating means may be two as mentioned above, or one or more than two.

Figure 6:
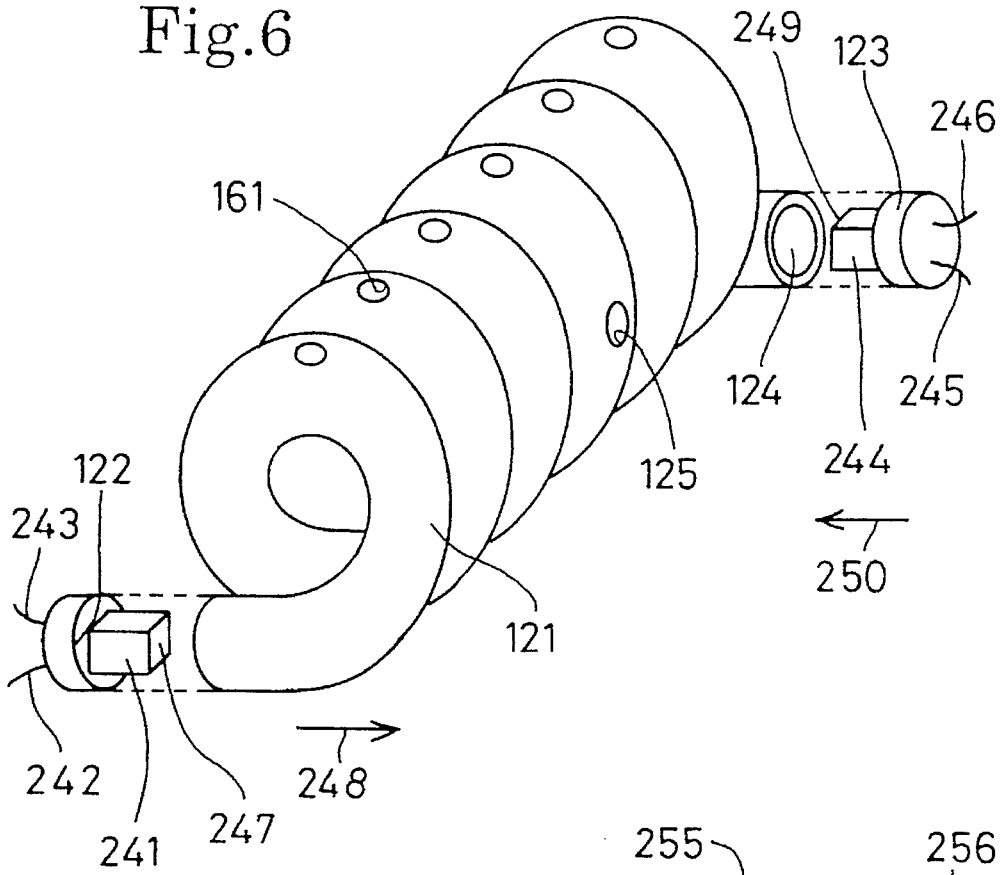
FIG. 6 is a perspective view of an ink jet apparatus in a third preferred embodiment according to the invention.

Next, the structure of a third preferred embodiment according to the invention will be described with reference to FIG. 6, which is a perspective view of an ink jet apparatus of the third preferred embodiment. In this preferred embodiment, a condition of synthesis of pressure wave pulses and a condition of jetting of ink droplets are similar to those mentioned in the first preferred embodiment, and so the explanation thereof will be omitted.

Reference numeral 121 denotes a chamber forming member formed by spirally bending a hollow tube to define therein an ink chamber having a plurality of coils. The ink chamber 124 spirally extends over the length of the chamber forming member 121. The chamber forming member 121 is provided with an ink inlet hole 125 communicating with the ink chamber 124. The chamber forming member 121 is further provided with a plurality of nozzles 161 arranged in one line.

The ink chamber 124 is open at its opposite ends and a pair of cover members 122 and 123 are bonded to the open end surfaces of the chamber forming member 121. Thus, the ink chamber 124 is fully closed except the ink inlet hole 125 and the nozzles 161. An end surface of a piezoelectric element 241 is bonded to the surface of the cover member 122 which is, in turn, bonded to one of the opposite end surfaces of the chamber forming member 121 and the piezoelectric element 241 is disposed in the ink chamber 124. A pair of conductor wires 242,243 are electrically connected to electrodes provided on the piezoelectric element 241, so that when a driving voltage is applied between the conductor wires 242,243, the piezoelectric element 241 produces an expansive deformation of about several nanometers to hundreds of micrometers in a direction depicted by an arrow 248 in FIG. 6. Similarly, an end surface of another piezoelectric element 244 is bonded to the surface of the cover member 124 which is, in turn, bonded to the other end surface of the chamber forming member 121, and the piezoelectric element 244 is disposed in the ink chamber 124. A pair of conductor wires 245,246 are electrically connected to electrodes provided on the piezoelectric element 244 so that when a driving voltage is applied between the conductor wires 245,246, the piezoelectric element 2.44 produces expansive deformation in a direction depicted by an arrow 250 in FIG. 6. Each of the piezoelectric elements 241,244 can be constructed of piezoelectric ceramics having a shape of rectangular parallelepiped in which electrodes are formed on the whole or a part of at least two opposite surfaces, or can be constructed of a stacked type of piezoelectric actuator.

The operation of the third preferred embodiment will now be described. A plurality of driving voltage pulses 301, each composed of a rise portion 301*a*, a hold portion 301*b*, and a fall portion 301*c* as shown in FIG. 2A, are applied between the conductor wires 242,243. At the time of application of the rise portion 301*a*, the piezoelectric element 241 produces the expansive deformation in the direction of the arrow 248 at a velocity corresponding to a rise speed of the driving voltage so that an end surface 247 of the piezoelectric element 241 compresses the ink contained in the ink chamber 124 in contact with the end surface 247. Thereafter, at the time of application of the hold portion 301*b*, the compression of the ink is ended. As a result, pulses of pressure waves (compression waves) are generated from the ink near the end surface 247 to travel in the ink chamber 124 toward the piezoelectric element 244 at a velocity of hundreds to thousands of meters per second. Similarly, a driving voltage pulse 303, as shown in FIG. 2B, is applied between the conductor wires 245,246 so that a pressure wave pulse is generated from the ink near an end surface 249 of the piezoelectric element 244 to travel in the ink chamber 124 toward the piezoelectric element 241.

In the ink jet apparatus in the first preferred embodiment, the width of the synthetic region 353 having the maximum pressure 2 P temporarily generated is equal to the width of each of the pressure wave pulses 351,352. If the width of the synthetic region 353 is greater than the distance between the nozzles 152*a* and 152*c* shown in FIG. 3A, the pressure 2 P of the synthetic region 353 temporarily acts not only to the nozzle 152*b* but also to the nozzles 152*a* and 152*c*, causing the ink droplets to be readily jetted also from the nozzles 152*a* and 152*c*. Accordingly, the width of each of the pressure wave pulses 351,352 cannot be set very large with the result that the time period of the application of the pressure 2 P to the nozzle 152*b* cannot be made so large. If this time period of application of the pressure 2 P is shortened, the amount of the ink that can pass under the nozzle 152*b* is reduced resulting in a decrease in the volume of the ink droplets jetted from the nozzle 152*b*. From this point of view, the volume of the ink droplets cannot be made larger than a given value in the ink jet apparatus in the first preferred embodiment.

To the contrary, in the ink jet apparatus of the third preferred embodiment, the spiral length of the ink chamber 124 between any two adjacent ones of the nozzles 161 is larger than the rectilinear distance between the two adjacent nozzles 161. Accordingly, the width of the pressure wave pulse can be made considerably larger by using the piezoelectric elements 241,244 each capable of obtaining a large amount of deformation to increase the rise time of the driving voltage pulse. As a result, the volume of the ink droplets can be increased.

Further, in comparison with the conventional ink jet apparatus wherein the number of the ink chambers and the energy generating means is the same as the number of the nozzles, the ink jet apparatus in this preferred embodiment is reduced in the number of parts because there is a single ink chamber 124 and the number of the piezoelectric elements 241,244, as the energy generating means, is smaller than the number of nozzles 161. Accordingly, the structure of the ink jet apparatus can be greatly simplified and the driving circuit for driving the energy generating means can be simplified and reduced in size. Thus, the ink jet apparatus can be manufactured at a low cost with an overall reduced size.

Figure 7:
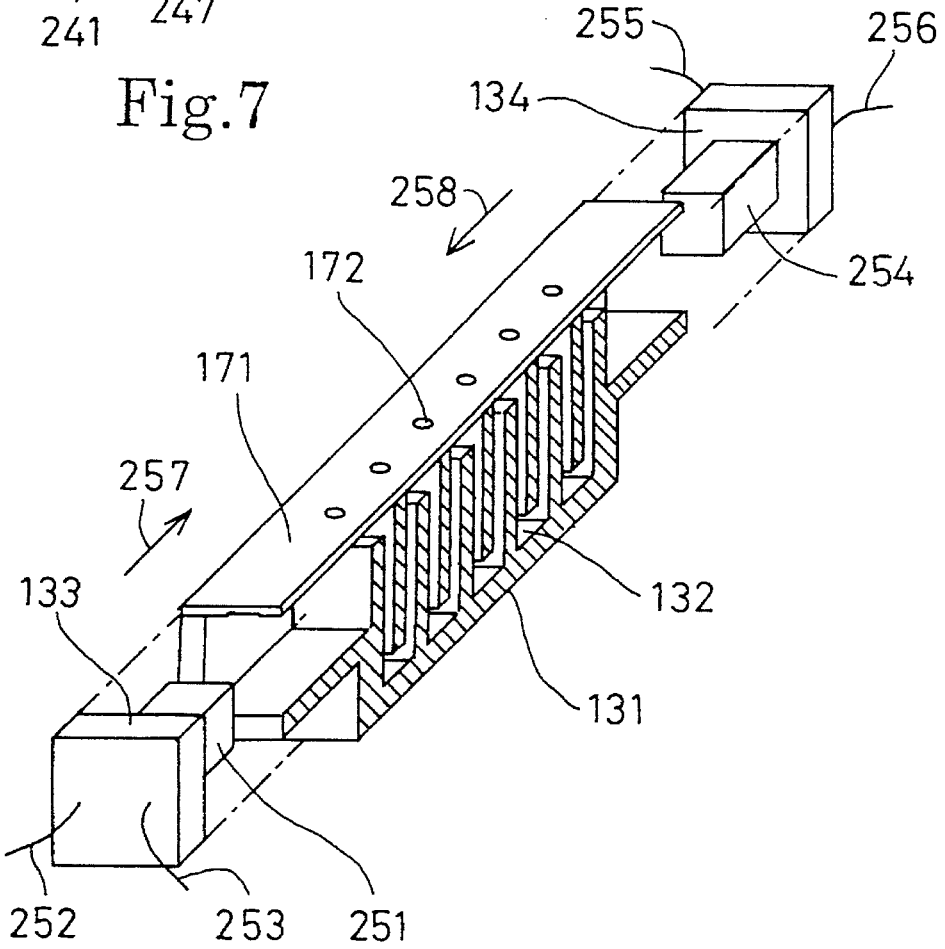
FIG. 7 is a perspective view, partially broken away, of an ink jet apparatus in a fourth preferred embodiment according to the invention.

While the ink chamber 124 is spiral in the third preferred embodiment, the shape of the ink chamber may be modified to shapes other than the spiral shape. A fourth preferred embodiment embodying such a case will be described with reference to FIG. 7.

Reference numeral 131 denotes a chamber forming member elongated in shape to define therein an ink chamber 132. The ink chamber 132 substantially zigzags to extend over the length of the chamber forming member 131. The zig-zag path is formed by a first set of baffles extending from a base of the ink chamber 132 and a second set of baffles extending from the nozzle plate 171. The chamber forming member 131 is provided with an ink inlet hole (not shown) communicating with the ink chamber 132. The ink chamber 132 is open at its upper portion to the upper surface of the chamber forming member 131, and a nozzle plate 171 having a plurality of nozzles 172 is bonded to the upper surface of the chamber forming member 131. The plural nozzles 172 are arranged at the same pitch as that of the zigzags of the ink chamber 132. The ink chamber 132 is open also at the opposite ends of the chamber forming member 131. A pair of cover members 133,134 are bonded to the opposite end surfaces of the chamber forming member 131. Thus, the ink chamber 132 is fully closed except for the ink inlet hole and the nozzles 172.

An end surface of a piezoelectric element 251 is bonded to the surface of the cover member 133 which surface is to be bonded to one of the opposite end surfaces of the chamber forming member 131, and the piezoelectric element 251 is disposed in the ink chamber 132. A pair of conductor wires 252,253 are electrically connected to electrodes provided on the piezoelectric element 251 so that when a driving voltage is applied between the conductor wires 252,253, the piezoelectric element 251 produces expansive deformation of about several nanometers to hundreds of micrometers in a direction depicted by an arrow 257 in FIG. 7. Similarly, an end surface of another piezoelectric element 254 is bonded to the surface of the cover member 134 which surface is to be bonded to the other end surface of the chamber forming member 131 and the piezoelectric element 254 is disposed in the ink chamber 132. A pair of conductor wires 255,256 are electrically connected to electrodes provided on the piezoelectric element 254 so that when a driving voltage is applied between the conductor wires 255,256, the piezoelectric element 254 produces expansive deformation in a direction depicted by an arrow 258 in FIG. 7. Each of the piezoelectric elements 251 and 254 may be constructed of piezoelectric ceramics having a shape of rectangular parallelepiped in which electrodes are formed on the whole or a part of at least two opposite surfaces or may be constructed of a stacked type of piezoelectric actuator.

The ink jet apparatus in the fourth preferred embodiment operates similarly to the third preferred embodiment to jet the ink droplets from the nozzles 172. Thus, substantially the same effect as that of the third preferred embodiment can be obtained.

In the ink jet apparatus in the first preferred embodiment, the possibility that the width of the synthetic region 353 having the maximum pressure 2 P shown in FIG. 3C may become the distance between the nozzles 152*a* and 152*c* shown in FIG. 3A can be avoided by improving the driving voltage pulse waveform to the piezoelectric element 201 and the driving voltage pulse waveform to the piezoelectric element 204. A fifth preferred embodiment embodying such an improvement in the driving voltage pulse waveforms will now be described. An ink jet apparatus in the fifth preferred embodiment has a basic structure similar to that of the ink jet apparatus in the first preferred embodiment. Accordingly, substantially the same parts as those in the first preferred embodiment are denoted by the same reference numerals and the explanation thereof will be omitted.

Figure 8A:
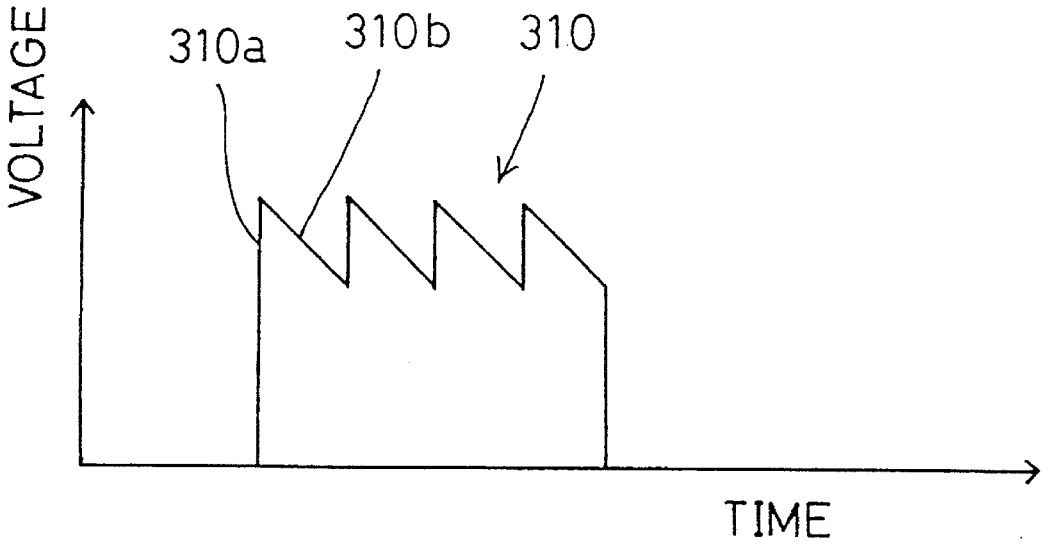
FIGS. 8A and 8B are waveform charts of driving voltage pulses to be applied to piezoelectric elements in a fifth preferred embodiment according to the present invention.
Figure 8B:
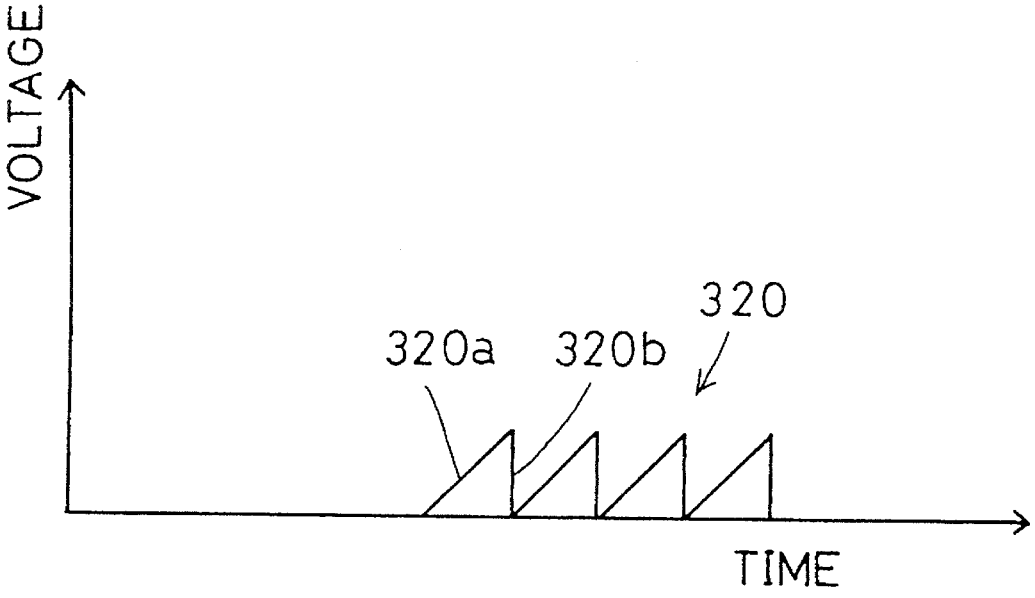
Figure 9A:
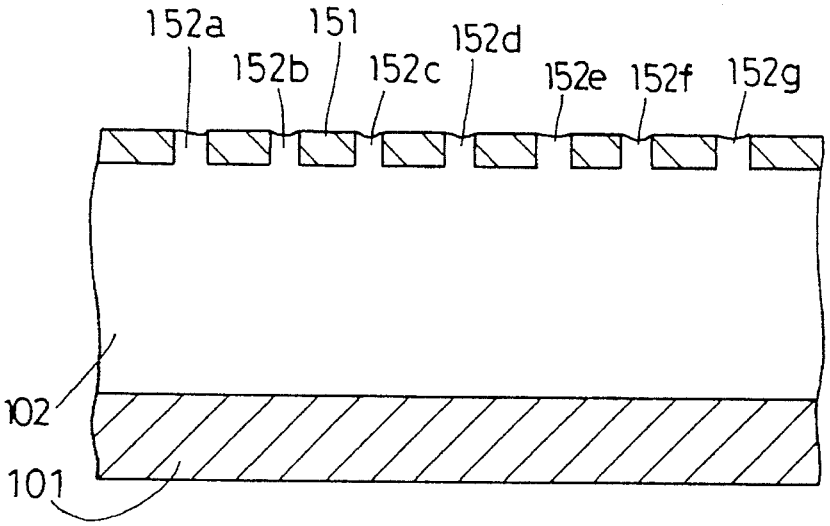
FIG. 9A is an enlarged sectional view of a part of an ink chamber in the fifth preferred embodiment.
Figure 9B:
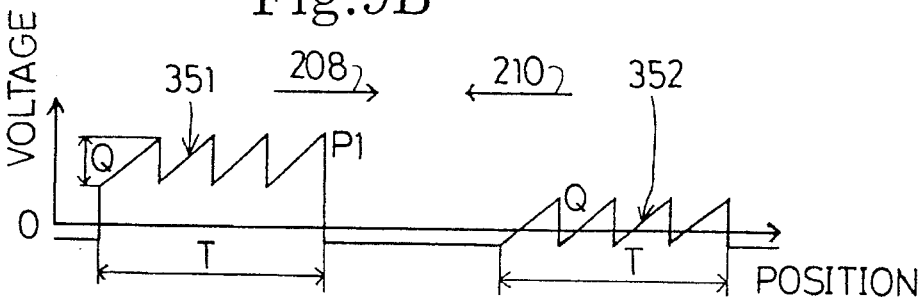
FIGS. 9B to 9D are waveform charts of pressure wave pulses generated by the piezoelectric elements in the fifth preferred embodiment.
Figure 9C:
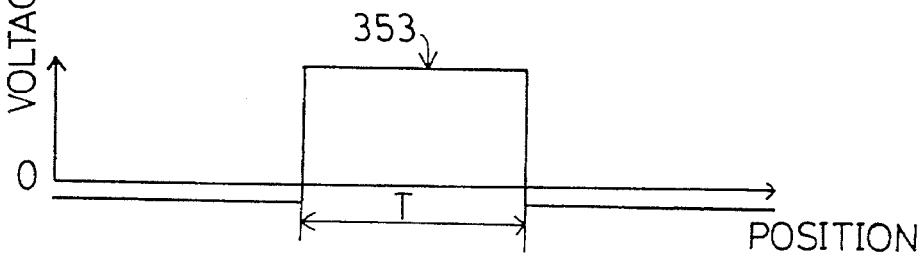
Figure 9D:
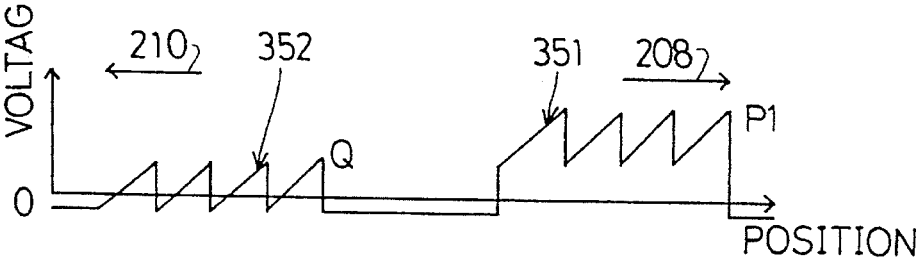
Figure 10A:
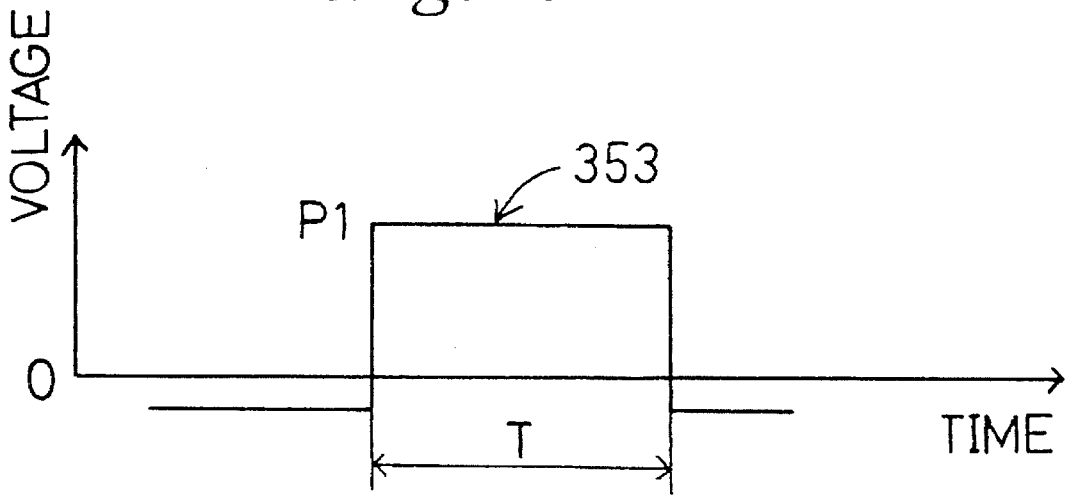
FIG. 10A is a waveform chart showing a change of ink pressure in terms of time just under a nozzle 152*d* shown in FIG. 9A.
Figure 10B:
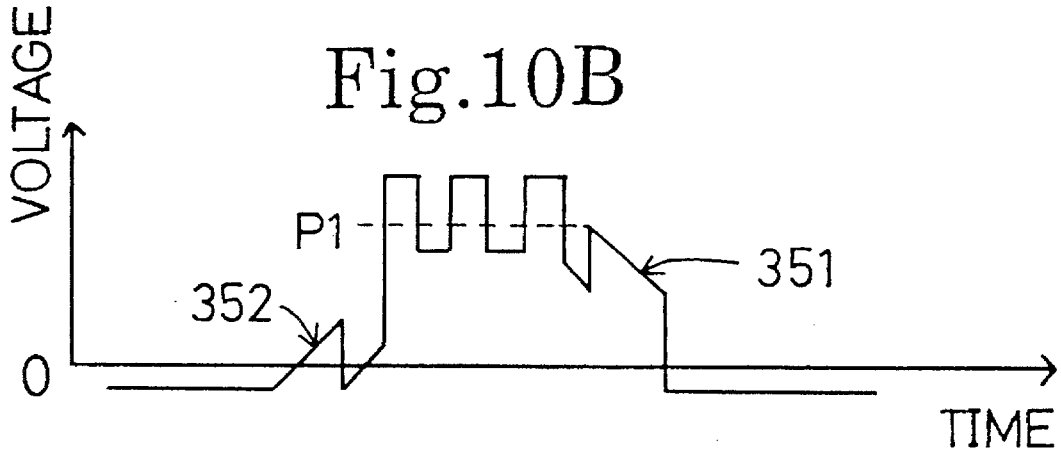
FIG. 10B is a waveform chart showing a change of ink pressure in terms of time just under a nozzle 152*e* shown in FIG. 9A.
Figure 10C:
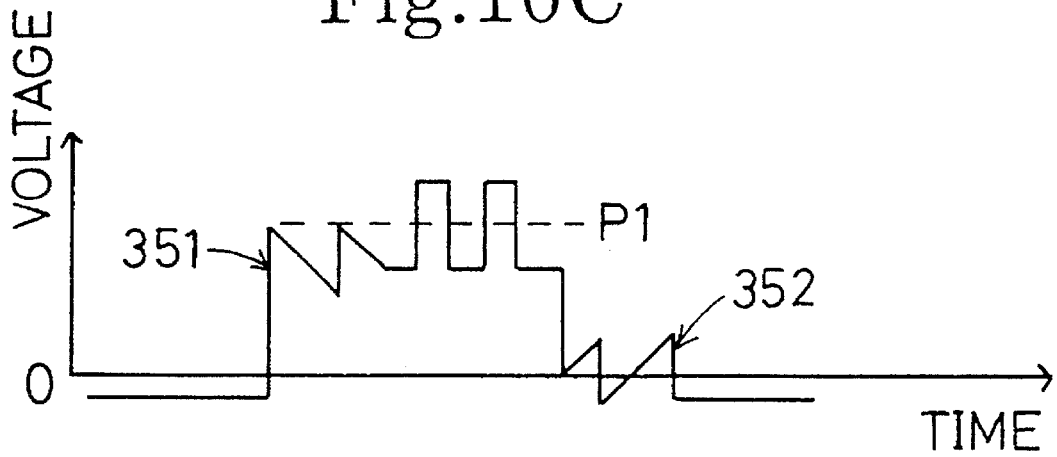
FIG. 10C is a waveform chart showing a change of ink pressure in terms of time just under a nozzle 152*c* shown in FIG. 9A.
Figure 11A:
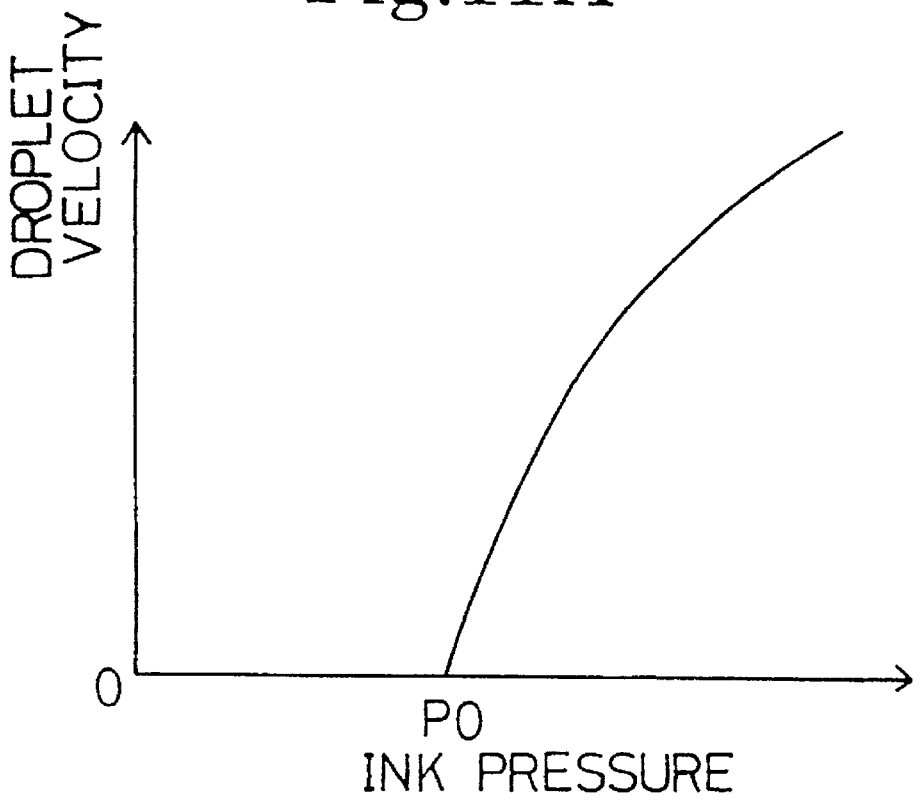
FIG. 11A is a graph showing a relation between ink pressure and droplet velocity.
Figure 11B:
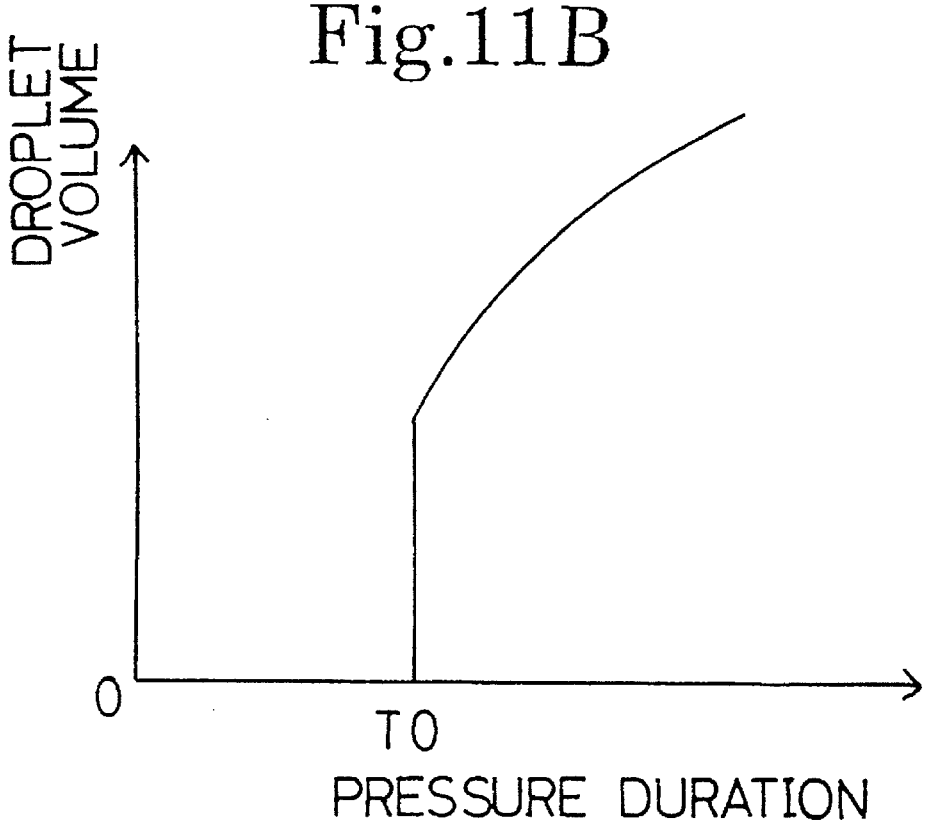
FIG. 11B is a graph showing a relation between pressure duration and droplet volume.

The operation of the fifth preferred embodiment will now be described with reference to FIGS. 8A and 8B showing waveforms of driving voltage pulses to be applied to piezoelectric elements 201,204 (see FIG. 1), FIGS. 9A to 9D and 10A to 10C showing a condition of synthesis of pressure wave pulses, FIG. 11A showing a relationship between ink pressure and droplet velocity, and FIG. 11B showing the relationship between ink pressure duration and droplet volume.

First, the condition for generation of pressure wave pulses to be generated by the piezoelectric elements 201,204 will be described. As shown in FIG. 8A, a driving voltage pulse 310 formed as a repetition of triangular pulse waveforms, each composed of a rise portion 310*a* rapidly rising and a fall portion 310*b* gently falling is applied between a conductor wire 202 (see FIG. 1) and a conductor wire 203 (see FIG. 1) from an LSI chip. Each triangular pulse waveform is a general triangular waveform to be obtained by applying a known integrating circuit. At the time of application of the rise portion 310*a*, the piezoelectric element 201 produces expansive deformation in a direction depicted by an arrow 208 in FIG. 1 at a velocity corresponding to a rise speed of the driving voltage, so that an end surface 207 (see FIG. 1) of the piezoelectric element 201 compresses the ink contained in an ink chamber 102 (see FIG. 1) near the end surface 207 to generate a positive pressure. Thereafter, starting at the application of the fall portion 310*b*, the piezoelectric element 201 produces compressive deformation to generate a negative pressure near the end surface 207. Then, as shown in FIG. 9B, a pressure wave (compression wave) pulse 351 formed as a repetition of triangular pulse waveforms depending upon the driving voltage pulse 310 is generated from the ink near the end surface 207 to travel in the ink chamber 102 in the direction of the arrow 208 at a velocity of hundreds to thousands of meters per second.

Similarly, as shown in FIG. 8B, a driving voltage pulse 320 formed as a repetition of triangular pulse waveforms each composed of a rise portion 320*a* gently rising and a fall portion 320*b* rapidly falling is applied between a conductor wire 205 (see FIG. 1) and a conductor wire 206 (see FIG. 1) from the LSI chip. The driving voltage pulse 320 has a shape such that when it is synthesized with the driving voltage pulse 310, a resultant synthetic waveform has a flat top portion. Each triangular pulse waveform is also a general triangular waveform to be obtained by applying a known integrating circuit. As apparent from FIGS. 8A and 8B, the inclination of the rise portion 320*a* of the pulse 320 is reversed in sign to that of the fall portion 310*b* of the pulse 310. Further, the period and the number of repetitions of the triangular pulse waveforms in the driving voltage pulse 320 are equal to those in the driving voltage pulse 310. When the driving voltage pulse 320 is applied, a pressure wave pulse 352 (see FIG. 9B) corresponding to the pulse 320 is generated from the ink contained in the ink chamber 102 near an end surface 209 (see FIG. 1) of the piezoelectric element 204 to travel in the ink chamber 102 in a direction depicted by an arrow 210 (see FIG. 1).

Next, a condition of synthesis of the pressure wave pulses and a condition of jetting of ink droplets will be described. It is assumed that the ink droplets are jetted from the nozzle 152*d* shown in FIG. 9A and that the pitch of the nozzles 152 is not equal to the width of each triangular pulse waveform of each of the pressure wave pulses 351,352. As shown in FIG. 9B, the pressure wave pulse 351 having a maximum pressure P1 and a width T generated from the piezoelectric element 201 scans in the direction of the arrow 208, whereas the pressure wave pulse 352 having a maximum pressure Q and a width T generated from the piezoelectric element 204 scans in the direction of the arrow 210. Thus, the pressure wave pulses 351,352 approach each other. Just thereafter, as shown in FIG. 9C, the pressure wave pulses 351,352 overlap to generate a synthetic region 353 as a synthesis of the pulses 351,352. Thereafter, when the pressure wave pulses 351,352 pass each other as shown in FIG. 9D, the synthetic region 353 disappears.

The LSI chip applies the voltages to the piezoelectric elements 201 and 204 to drive them at a timing such that the pressure wave pulses 351,352 meet together at a position just under the nozzle 152*d* shown in FIG. 9A, thereby applying to the nozzle 152*d* a pressure having a magnitude P1 and a duration T as shown in FIG. 10A. The magnitude P1 is obtained as a synthesis of the maximum pressure P1 of the pressure wave pulse 351 and the maximum pressure Q of the pressure wave pulse 352, and the duration T is equal to the width T of each of the pressure wave pulses 351,352. At this time, as shown in FIG. 10B, a pressure having a magnitude greater than the magnitude P1 is temporarily applied several times to the nozzle 152*e* adjacent to the nozzle 152*d* on the piezoelectric element 204 side because the pressure wave pulse 352 passes under the nozzle 152*e* prior to the pressure wave pulse 351. Similarly, as shown in FIG. 10C, a pressure having a magnitude greater than the magnitude P1 is temporarily applied several times to the nozzle 152*c* adjacent to the nozzle 152*d* on the piezoelectric element 201 side, because the pressure wave pulse 351 passes under the nozzle 152*c* prior to the pressure wave pulse 352.

Thus, the pressure having the magnitude P1 or the magnitude greater than the magnitude P1 is temporarily applied several times to the nozzles 152 during scanning of the pressure wave pulses 351 and 352 in the ink chamber 102. In particular, the pressure having the magnitude P1 and the duration T is applied to the nozzle 152*d* only. Further, the movement of the pressure wave pulses 351,352 in the ink chamber 102 also causes the pressure to be temporarily applied to the ink inlet hole 103. However, since the ink inlet hole 103 is filled with the ink, the pressures of the pressure wave pulses 351,352 have almost no influence upon the ink tank, and the pressure loss of the pressure wave pulses 351,352 at the ink inlet hole 103 is small.

In general, an ink pressure is related to a droplet velocity as shown in FIG. 11A. Accordingly, when the magnitude of the pressure is less than P0, no ink droplets are jetted. Further, a duration of application of an ink pressure is related to a droplet volume as shown in FIG. 11B. Accordingly, when the duration of the pressure is less than T0, no ink droplets are jetted. The duration T0 is a minimum duration required to jet the ink droplets under the pressure having the magnitude P0. The greater the magnitude of the ink pressure, the shorter the duration of the ink pressure.

Thus, only when a pressure having a magnitude not less than the predetermined value P0 and a duration not less than the predetermined time T0 is applied, are the ink droplets jetted. Therefore, the ink droplets are jetted from the nozzle 152*d* only to which the pressure having the magnitude P1 and the duration T meeting the above-mentioned relationship of P0 and T0 is applied, whereas the ink droplets are not jetted from the nozzles 152*c* and 152*e* and the other nozzles to which the pressure having the magnitude P1 or greater but not meeting the relationship of P0 and T0 is applied. Further, by changing a timing of the generation of the pressure wave pulses 351,352 from the piezoelectric elements 201,204, the ink droplets can be jetted from an arbitrary one of the nozzles 152.

As mentioned above, in the ink jet apparatus in the fifth preferred embodiment, the driving voltage pulses 310,320 are each composed of repeated triangular pulse waveforms applied from the LSI chip to the piezoelectric elements 201,204 to thereby generate the pressure wave pulses 351, 352 similar in shape to the driving voltage pulses 310,320 in the ink chamber 102. Accordingly, the pressure wave pulses 351,352 are synthesized at a position just under the selected nozzle 152*d* to thereby apply to the nozzle 152*d* the pressure having the magnitude P1 and the duration T meeting the relationship of P0 and T0, thus jetting the ink droplets from the nozzle 152*d* only. While the pressure having the magnitude P1 or greater is temporarily applied to the nozzles 152*c* and 152*e* and other nozzles except the nozzle 152*d*, no ink droplets are jetted from these nozzles because the pressure does not meet the relationship of P0 and T0. As a result, the ink is prevented from being deposited onto improper positions on a recording paper, thus improving the print quality.

In other words, the LSI chip as control means controls the system so that a pressure generated by synthesizing the pressure wave pulses and having a magnitude not less than a predetermined value and a duration not less than a predetermined time is applied to a subject nozzle but is not applied to other nozzles adjacent to the subject nozzle. Therefore, no ink droplets are jetted from the adjacent nozzles to thereby improve the print quality.

In this preferred embodiment, the driving voltage pulses 310,320 each composed of repeated triangular pulse waveforms are applied to the piezoelectric elements 201,204, respectively. However, the repeated triangular pulse waveforms may be replaced by any other repeated pulse waveforms such as repeated rectangular pulse waveforms.

Further, although the triangular pulse waveforms are repeated in the driving voltage pulses 310,320 in this preferred embodiment, the repetition of the triangular pulse waveforms is not essential.

In this preferred embodiment, the pitch of the nozzles 152 is not equal to the width of each triangular pulse waveform of the pressure wave pulses 351,352. However, the pitch of the nozzles 152 may be equal to the width of each triangular pulse waveform or the total width of the plural triangular pulse waveforms. In this case, the pitch is set so as not to meet the relationship of P0 and T0, because the pressure having the magnitude P1 is applied to all the nozzles 152 inclusive of the subject nozzle 152*d*.

Further, although the two piezoelectric elements 201,204 are used in this preferred embodiment, three or more piezoelectric elements may be used to jet the ink droplets.

Further, since the basic structure of this preferred embodiment is similar to that of the first preferred embodiment, the various modifications of the first preferred embodiment as mentioned above may be similarly applied to this preferred embodiment. In addition, the modifications of this preferred embodiment may be similarly applied to the first preferred embodiment.

Figure 12:
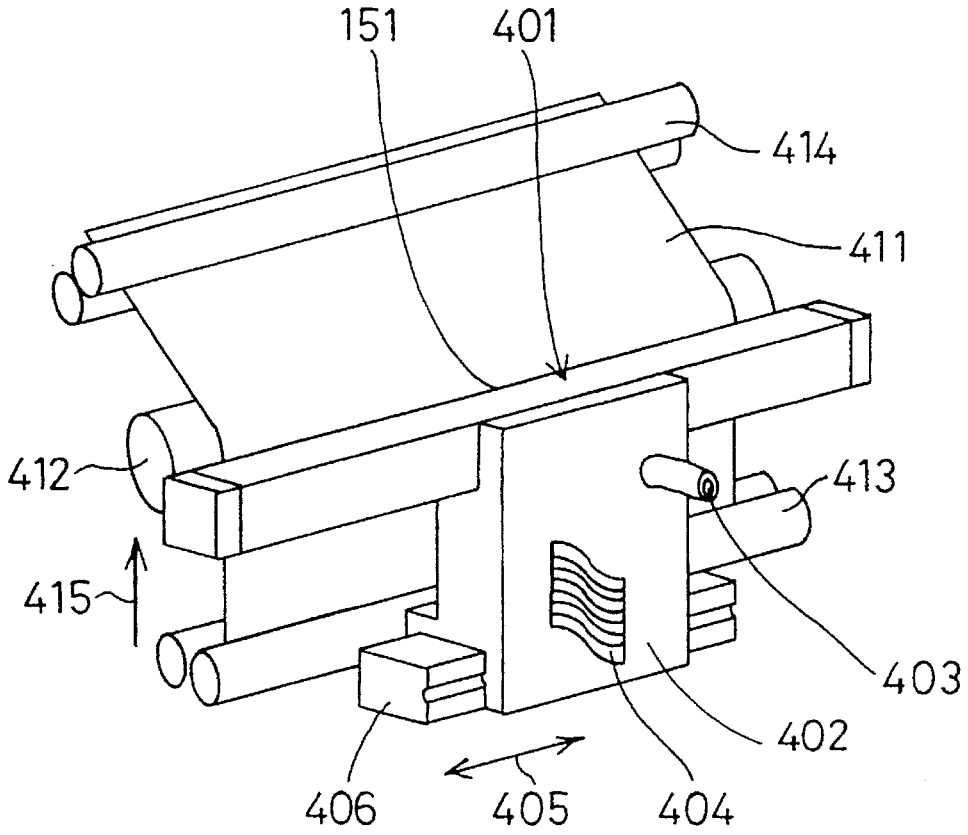
FIG. 12 is a perspective view of a part of a printer employing the ink jet apparatus according to the present invention.
Figure 13:
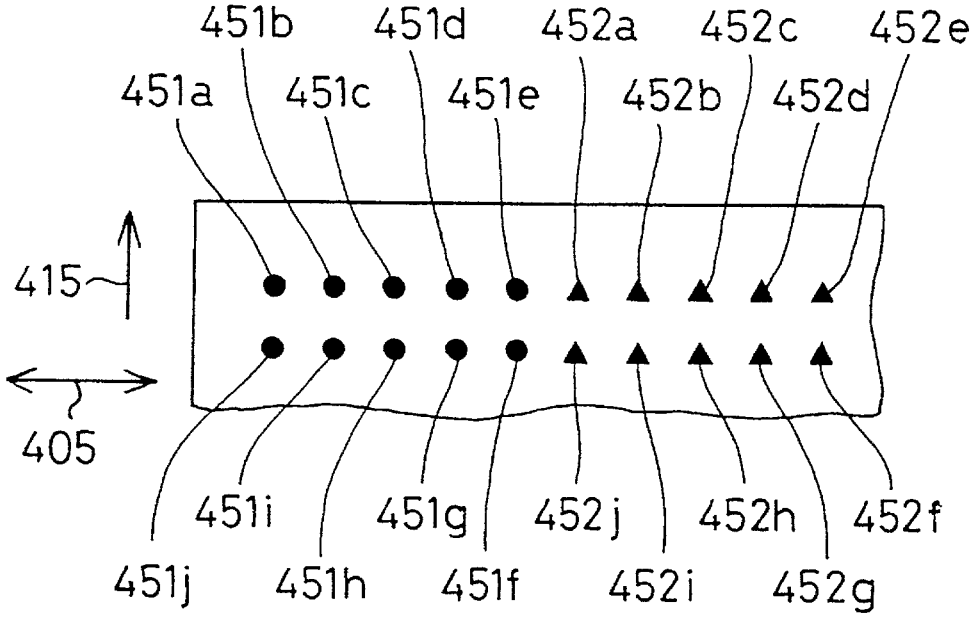
FIG. 13 is a schematic diagram showing positions of deposition of ink droplets on a recording paper by the printer shown in FIG. 12.

Next, a printer employing the ink jet apparatus according to the invention will be described with reference to FIG. 12 showing a perspective view of the printer and FIG. 13 showing the positions of deposition of ink droplets on a recording paper. The structure and operation of the ink jet apparatus employed in this printer are similar to those mentioned in the first preferred embodiment. That is, the printer shown in FIG. 12 includes an ink jet apparatus 401 and a nozzle plate 151 similar in structure and operation to those shown in FIGS. 1 to 4.

The ink jet apparatus 401 is fixed to a carriage 402. An ink supply tube 403 is connected to an ink inlet hole 103 (see FIG. 1). A flexible cable 404 is electrically connected to conductor wires 202,203,205,206 through the LSI chip (see FIG. 1). The carriage 402 is reciprocated along a slider 406 in opposite directions as depicted by the double-headed arrow 405 in FIG. 12. During movement of the carriage 402, the ink jet apparatus 401 operates to jet ink droplets from nozzles 152 (see FIG. 1) of the nozzle plate 151 onto a recording paper 411 supported on a platen roller 412, thereby forming desired characters or images on the recording paper 411. When the ink jet apparatus 401 jets the ink droplets, the recording paper 411 is kept at rest. Every time the carriage 402 changes the direction of reciprocation, the recording paper 411 is fed by paper feed rollers 413,414 by a given amount in a direction depicted by an arrow 415 in FIG. 12. Accordingly, the ink jet apparatus 401 can form desired characters or images on the whole surface of the recording paper 411.

Referring to FIG. 13, when the carriage 402 is moved in a rightward direction of the arrow 405, the ink jet apparatus 401 jets the ink droplets from a first one of the nozzles 152 onto the recording paper 411 to deposit the ink droplets at a series of points 451*a*, 451*b*, 451*c*, 451*d*, 451*e* in order on the recording paper 411. Simultaneously, the ink jet apparatus 401 jets the ink droplets from a second one of the nozzles 152 adjacent to the first nozzle 152 on the right-hand side thereof onto the recording paper 411 to deposit the ink droplets at a series of points 452*a*, 452*b*, 452*c*, 452*d*, 452*e* in order on the recording paper 411. Thereafter, while the carriage 402 changes from moving in the rightward direction to movement in a leftward direction, as shown by the arrow 405, the recording paper 411 is fed by a given amount in the direction of the arrow 415. When the carriage 402 is moved in the leftward direction of the arrow 405, the ink jet apparatus 401 jets the ink droplets from the first nozzle 152 onto the recording paper 411 to deposit the ink droplets at a series of points 451*f*, 451*g*, 451*h*, 451*i*, 451*j* in order on the recording paper 411. Simultaneously, the ink jet apparatus 401 jets the ink droplets from the second nozzle 152 onto the recording paper 411 to deposit the ink droplets at a series of points 452*f*, 452*g*, 452*h*, 452*i*, and 452*j* in this order on the recording paper 411. This operation is repeated to thereby form the desired characters or images on the whole surface of the recording paper 411.

To deposit the ink droplets at regular intervals on the recording paper 411, it is necessary to make uniform the distance between any adjacent deposition points, such as the distance between the points 451*a* and 451*b* and the distance between the points 451*e* and 452*d*. In the printing method mentioned above, while the carriage 402 is moved once in the rightward or leftward direction, one nozzle performs jetting of the ink droplets five times. Further, the distance between the adjacent nozzles is set to five times the distance between the adjacent deposition points, and the moving distance of the carriage 402 in the rightward or leftward direction is set to at least four times the distance between the adjacent deposition points. However, the number of times of jetting of the ink droplets from one nozzle during the rightward or leftward movement of the carriage 402 is not limited to five. For example, letting n denote the number of times of jetting, the distance between the adjacent nozzles becomes n times the distance between the adjacent deposition points, and the moving distance of the carriage 402 becomes at least (n−1) times the distance between the adjacent deposition points.

The recording paper 411 may be fed continuously at a constant speed irrespective of whether or not the ink jet apparatus 401 jets the ink droplets. The operation in this case will be described with reference to FIG. 14 showing a condition of deposition of the ink droplets.

Figure 14:
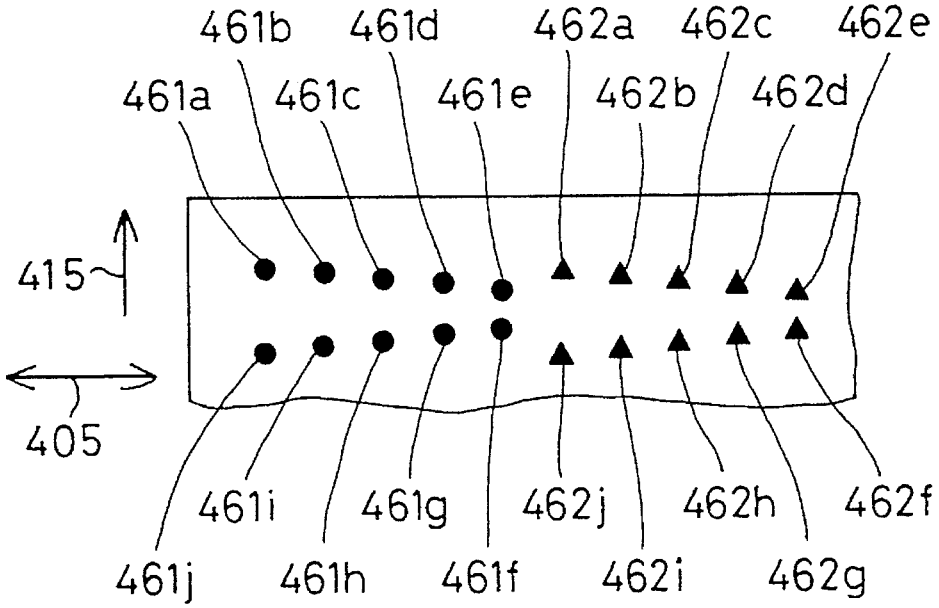
FIG. 14 is a view similar to FIG. 13, showing a modification in which the recording paper is fed during jetting of the ink droplets.
Figure 15:
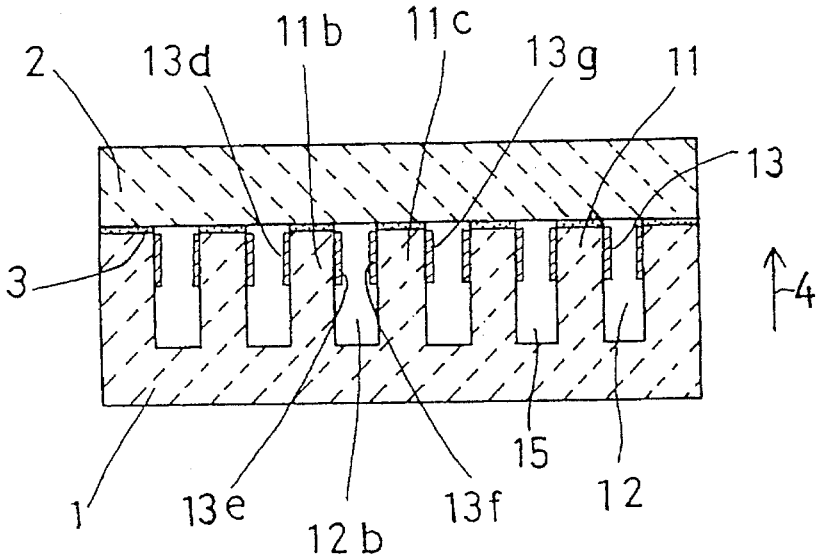
Fig.15 PRIOR ART
FIG. 15 is a sectional view of an ink jet apparatus in the prior art.
Figure 16:
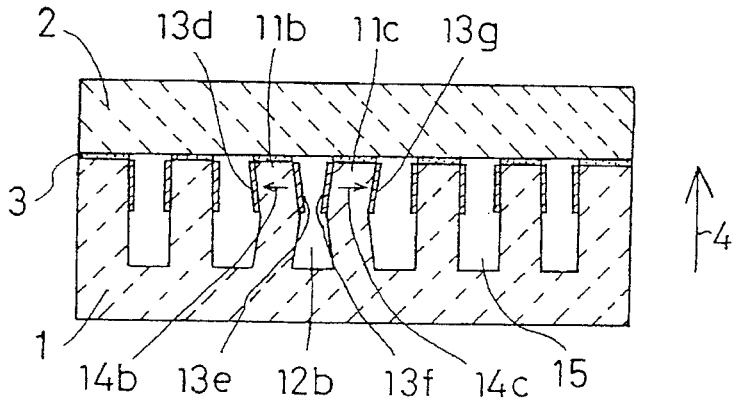
Fig.16 PRIOR ART
FIG. 16 is a sectional view showing the operation of the ink jet apparatus shown in FIG. 15.
Figure 17:
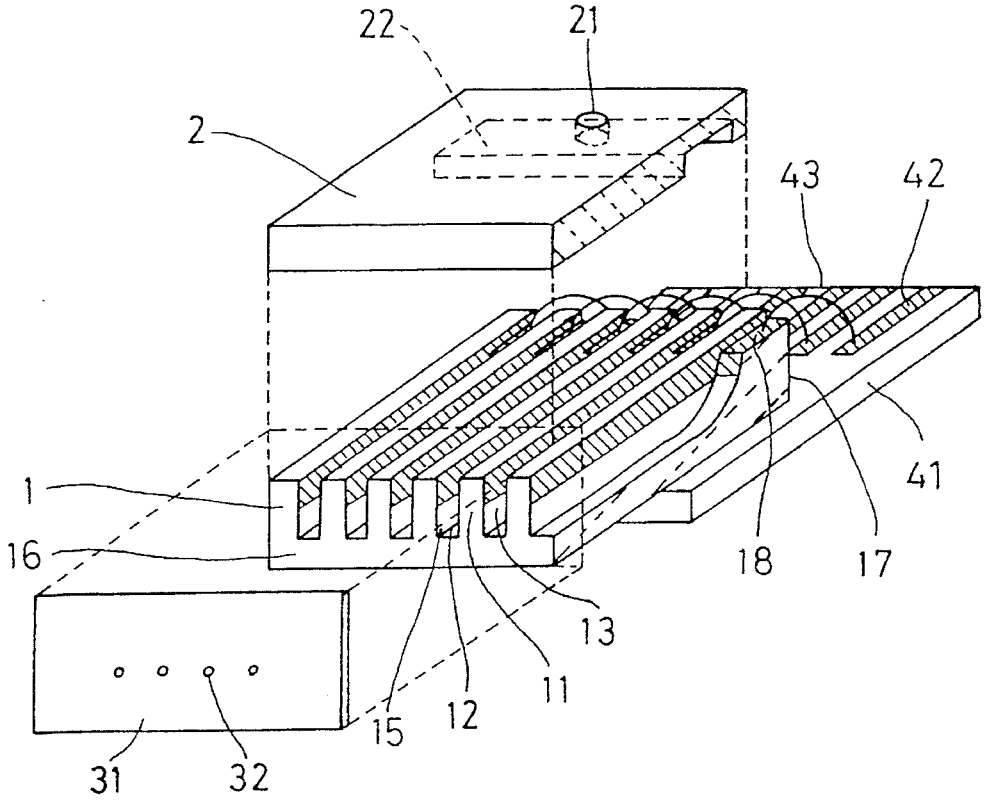
Fig.17 PRIOR ART
FIG. 17 is an exploded perspective view, partially broken away, of the ink jet apparatus shown in FIG. 15.
Figure 18:
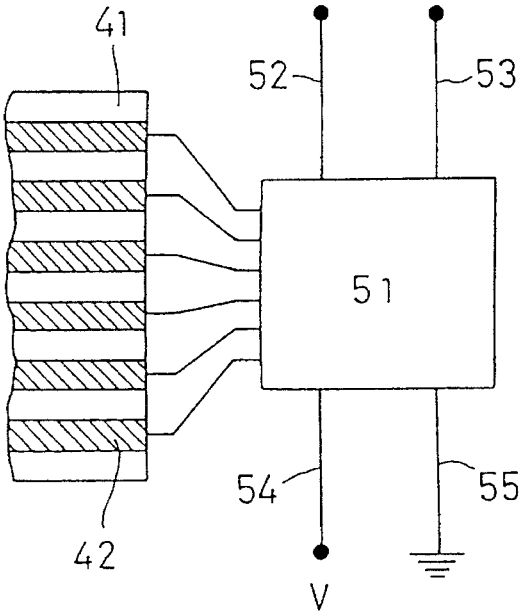
Fig.18 PRIOR ART
FIG. 18 is a block diagram of a control section for the ink jet apparatus shown in FIG. 17.
Figure 19:
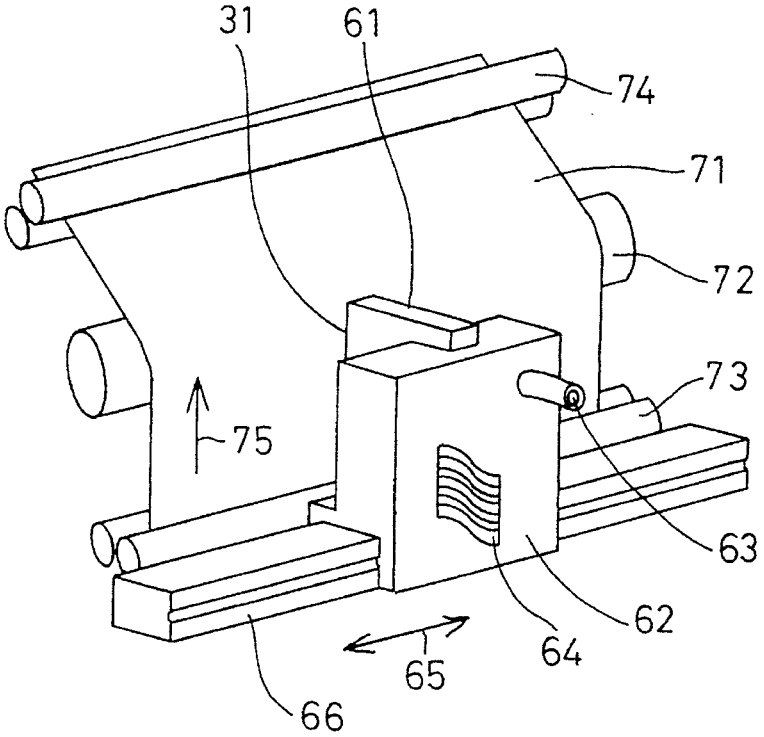
Fig.19 PRIOR ART
FIG. 19 is a perspective view of a part of a printer employing the ink jet apparatus shown in FIG. 17.

Referring to FIG. 14, when the carriage 402 is moved in the rightward direction of the arrow 405, the ink jet apparatus 401 jets the ink droplets from a first one of the nozzles 152 onto the recording paper 411 being fed in the direction of the arrow 415 to deposit the ink droplets at a series of points 461*a*, 461*b*, 461*c*, 461*d*, 461*e* in order on the recording paper 411. Simultaneously, the ink jet apparatus 401 jets the ink droplets from a second one of the nozzles 152 adjacent to the first nozzle 152 on the right-hand side thereof onto the recording paper being fed in the direction of the arrow 451 to deposit the ink droplets at a series of points 462*a*, 4462*b*, 462*c*, 462*d*, 462*e* in order on the recording paper 411. Thereafter, the carriage 402 changes the rightward direction of movement to a leftward movement direction shown by the arrow 405. When the carriage 402 is moved in the leftward direction of the arrow 405, the ink jet apparatus 401 jets the ink droplets from the first nozzle 152 onto the recording paper 411 being fed in the direction of the arrow 415 to deposit the ink droplets at a series of points 461*f*, 461*g*, 461*h*, 461*i*, 461*j* in order on the recording paper 411. Simultaneously, the ink jet apparatus 401 jets the ink droplets from the second nozzle 152 onto the recording paper 411 being fed in the direction of the arrow 415 to deposit the ink droplets at a series of points 462*f*, 462*g*, 462*h*, 462*i*, 462*j* in order on the recording paper 411. The operation is repeated to thereby form desired characters or images on the whole surface of the recording paper 411.

In this printer, the single ink jet apparatus 401 having a single ink chamber is mounted on the carriage 402 to deposit the ink droplets on the whole surface of the recording paper 411. In a modification, a plurality of such an ink jet apparatus may be mounted on the carriage 402 so as to be arranged in the feeding direction of the recording paper 411, thus depositing the ink droplets on the whole surface of the recording paper 411.

In the conventional printer, the ink jet apparatus fixed to the carriage is reciprocated by a distance corresponding to the width of the recording paper. To the contrary, in the printer shown in FIG. 12, the ink jet apparatus 401 fixed to the carriage 402 is reciprocated by a reduced distance not greater than the distance between the adjacent nozzles. Accordingly, the stroke of the carriage 402 can be greatly reduced. In comparison with a printer having an identical number of nozzles and printing speed to the printer shown in FIG. 12, the moving speed and the acceleration acting on the carriage 402 in changing the direction of reciprocation can be greatly reduced. Accordingly, generation of undue pressure in the ink chamber due to the acceleration acting on the ink jet apparatus 401 can be reduced to thereby reduce turbulence of jet of the ink droplets and improve the print quality.

Further, since the carriage 402 is moved in such a manner as mentioned above, the distance between the adjacent nozzles can be actually widened. Accordingly, the width of the pressure wave can be set large to thereby enlarge the volume of the ink droplets.

Further, moving means for the carriage can be simplified in structure to thereby reduce a cost of printer.

Although the ink jet apparatus in the first preferred embodiment is mounted in the printer shown in FIG. 12, the ink jet apparatus in any one of the second to fifth preferred embodiments mentioned above may be so mounted.

As described above, in the ink jet apparatus according to the invention, the number of the energy generating means is smaller than the number of the jet nozzles, and the scanning direction of the pressure wave generated in the ink contained in the ink chamber is substantially perpendicular to the jet nozzles. Accordingly, the structure of the ink jet apparatus can be simplified and a driving circuit for driving the energy generating means can be simplified and reduced in size. Especially, in forming a so-called line head such that an ink jet apparatus is arranged with the same integration degree as that desired to deposit ink droplets on a recording paper and extends over the width of the recording paper, the conventional ink jet apparatus requires greatly increased numbers of energy generating means and ink chambers. In comparison with this, the numbers of the energy generating means and the ink chambers can be greatly reduced in the ink jet apparatus according to the invention. Accordingly, the ink jet apparatus can be manufactured at a low cost with a reduced size as a whole.

What is claimed is:

1. An ink jet apparatus, comprising:

an ink chamber filled with ink;

a plurality of jet nozzles communicating with said ink chamber;

energy generating means for generating pressure waves in the ink contained in said ink chamber to jet the ink from said jet nozzles;

energy control means for controlling said energy generating means to generate the pressure waves so that one of the pressure waves generated by said energy generating means is synthesized with another one of the pressure waves generated by said energy generating means to thereby jet the ink from subject jet nozzle of said plurality of jet nozzles.

2. An ink jet apparatus as claimed in claim 1, wherein said energy generating means are less in number than said jet nozzles.

3. An ink jet apparatus as claimed in claim 2, wherein a scanning direction of said pressure waves generated in the ink contained in said ink chamber by said energy generating means is substantially perpendicular to said jet nozzles.

4. An ink jet apparatus as claimed in claim 1, wherein said energy control means includes means for controlling said energy generating means to generate pressure waves so that the synthesized pressure wave is created where the pressure waves overlap and applies a pressure having a magnitude not less than a predetermined value and a duration not less than a predetermined time to a subject one of the jet nozzles and thereby jets the ink from the subject one of the jet nozzles.

5. The ink jet apparatus as claimed in claim 1, wherein said energy control means controls said energy generating means based on a first driving voltage pulse and a second driving voltage pulse, the first driving voltage pulse being formed as a repetition of triangular pulse waveforms, each waveform composed of a rise portion rapidly rising and a fall portion gently falling, and the second driving voltage pulse being formed as a repetition of triangular pulse waveforms, each waveform composed of a rise portion gently rising and a fall portion rapidly falling.

6. The ink jet apparatus as claimed in claim 5, wherein the inclination of the rise portion of the second driving voltage pulse is reversed in sign to that of the fall portion of the first driving voltage pulse.

7. An ink ejecting device, comprising:

an elongated ink chamber open at each end;

a plurality of ink nozzles communicating with said ink chamber;

first pressure generating means for generating pressure waves, mounted in a first open end of said ink chamber to close the first open end;

closure means for closing the second open end; and control means for energizing said first pressure generating means to generate the pressure waves in ink in said ink chamber, wherein said closure means is one of a reflecting means for reflecting pressure waves generated be said first pressure generating means and a second pressure generating means for generating pressure waves which is controlled by said control means.

8. The ink ejecting device as claimed in claim 7, wherein a direction of movement of the pressure waves generated in the ink contained in said ink chamber by said first pressure generating means and said second pressure generating means is substantially perpendicular to said ink nozzles.

9. The ink ejecting device as claimed in claim 7, wherein said control means includes means for controlling said first pressure generating means and said second pressure generating means to generate pressure waves so that a synthesized pressure wave is created where the pressure waves overlap and applies a pressure having a magnitude not less than a predetermined value and a duration not less than a predetermined time to a subject one of the plurality of jet nozzles and thereby jets the ink from the subject one of the plurality of jet nozzles.

10. The ink ejecting device as claimed in claim 9, wherein said control means controls said first pressure generating means and said second pressure generating means based on a first driving voltage pulse applied to said first pressure generating means and a second driving voltage pulse applied to said second pressure generating means, the first driving voltage pulse being formed as a repetition of triangular pulse waveforms, each waveform composed of a rise portion rapidly rising and a fall portion gently falling, and the second driving voltage pulse being formed as a repetition of triangular pulse waveforms, each waveform composed of a rise portion gently rising and a fall portion rapidly falling.

11. The ink ejecting device as claimed in claim 10, wherein the inclination of the rise portion of the second driving voltage pulse is reversed in sign to that of the fall portion of the first driving voltage pulse.

12. The ink ejecting device as claimed in claim 7, wherein said plurality of ink nozzles are aligned such that if joined together a straight line would pass therethrough.

13. The ink ejecting device as claimed in claim 12, wherein said ink chamber is a tube that is spirally formed to have a plurality of coil.

14. The ink ejecting device as claimed in claim 13, wherein an ink nozzle of said plurality of ink nozzles is formed on each coil of the plurality of coils of said spirally formed tube ink chamber.

15. The ink ejecting device as claimed in claim 14, wherein said baffles are divided into a first set of baffles extending from a base of said ink chamber toward but separated from a side of said ink chamber containing said plurality of ink nozzles and a second set of baffles extending from the side containing said plurality of ink nozzles toward but separated from said base, said first set of baffles and said second set of baffles being offset from one another to create the zig-zag path.

16. The ink ejecting device as claimed in claim 12, wherein said elongated ink chamber has formed therein a plurality of baffles arranged in zig-zag manner to thereby create a zig-zag path for the pressure waves to follow through the ink chamber.

17. The ink ejecting device as claimed in claim 16, wherein each nozzle of said plurality of nozzles is positioned between two baffles of said second set of baffles.

* * * * *